US005840457A

United States Patent [19]

Urawa et al.

[11] Patent Number: 5,840,457

[45] Date of Patent: Nov. 24, 1998

[54] MAGNETIC BLACK TONER AND MULTI-COLOR OR FULL-COLOR IMAGE FORMING METHOD

[75] Inventors: Motoo Urawa, Funabashi; Keita Nozawa, Shizuoka-ken; Hiroshi Yusa, Machida; Takashige Kasuya; Yuki Karaki, both of Shizuoka-ken; Kazuo Maruyama, Mishima; Masao Takano, Susono, all of Japan

[73] Assignee: Canon Kabushiki Kaisha, Tokyo, Japan

[21] Appl. No.: 902,945

[22] Filed: Jul. 30, 1997

[30] Foreign Application Priority Data

Jul. 31, 1996 [JP] Japan ..... 8-216845
Jul. 24, 1997 [JP] Japan ..... 9-198025

[51] Int. Cl.[6] ..... G03G 13/01; G03G 9/083

[52] U.S. Cl. ..... 430/45; 430/106; 430/106.6; 430/111

[58] Field of Search ..... 430/106, 106.6, 430/45, 111

[56] References Cited

U.S. PATENT DOCUMENTS

| | | | |
|---|---|---|---|
| 5,180,649 | 1/1993 | Kukimoto et al. | 430/106.6 |
| 5,268,248 | 12/1993 | Tanikawa et al. | 430/106 |
| 5,298,354 | 3/1994 | Matsunaga et al. | 430/99 |
| 5,330,871 | 7/1994 | Tanikawa et al. | 430/111 |
| 5,338,638 | 8/1994 | Tsuchiya et al. | 430/106 |
| 5,618,648 | 4/1997 | Horikoshi et al. | 430/109 |
| 5,744,276 | 4/1998 | Ohno et al. | 430/110 |

FOREIGN PATENT DOCUMENTS

| | | |
|---|---|---|
| 0427272 | 5/1991 | European Pat. Off. . |
| 0587540 | 3/1994 | European Pat. Off. . |
| 0618511 | 10/1994 | European Pat. Off. . |
| 0718703 | 6/1996 | European Pat. Off. . |
| 63-259575 | 10/1988 | Japan . |
| 63-296055 | 12/1988 | Japan . |
| 3-231757 | 10/1991 | Japan . |

OTHER PUBLICATIONS

Database WPI, Week 9313, Derwent Publ. AN 93–155015, XP002047498 of JP 5–88412.

*Primary Examiner*—Roland Martin
*Attorney, Agent, or Firm*—Fitzpatrick, Cella, Harper & Scinto

[57] ABSTRACT

A magnetic black toner for electrophotography, includes: (a) magnetic black toner particles containing a binder resin, a magnetic material in 30–200 wt. parts per 100 wt. parts of the binder resin, and a first solid wax, and (b) first inorganic fine powder. The first solid wax (ii) provides a DSC heat-absorption main peak in a range of 60°–120° C., and (iii) shows a molecular weight distribution factor Mw/Mn of 1.0–2.0. The binder resin (iv) has a THF (tetrahydrofuran) -insoluble content of at most 5 wt. %, and (v) contains a THF-soluble content showing a GPC molecular weight distribution including a content (M1) of 40–70% in molecular weights of below $5\times10^4$, a content (M2≦M1) of 20–45% in molecular weights of $5\times10^4$–$5\times10^5$, and a content (M3<M2) of 2–25% in molecular weights exceeding $5\times10^5$. (vi) The magnetic black toner exhibits a tan δ of 0.5–3.0 in a range of 150°–190° C. and a tan δ at 150° C. that is equal to or larger than a tan δ at 100° C. The magnetic black toner shows a good fixability in an oil-less fixation system to provide a fixed image having a gloss comparable to one obtained by a non-magnetic color toner.

59 Claims, 10 Drawing Sheets

MAGNETIC BLACK TONER AND MULTI-COLOR OR FULL-COLOR IMAGE FORMING METHOD

FIELD OF THE INVENTION AND RELATED ART

The present invention relates to a magnetic toner for developing electrostatic latent images used in electrophotography, electrostatic recording, etc., and an image forming method using the magnetic toner. More specifically, the present invention relates to a magnetic black toner for developing an electrostatic latent image on an image bearing member to form a toner image, which is transferred to a transfer-receiving material via or without via an intermediate transfer member, and a multi-color or full-color image forming method, adapted for use in an image forming apparatus, such as a copying machine, a printer, a facsimile apparatus, etc.

Hitherto, a large number of electrophotographic processes have been known. Generally, an electrostatic latent image is formed on a photosensitive member comprising a photoconductive material and developed to form a toner image, which is then transferred onto a transfer-receiving material, such as paper, and fixed thereon under application of heat, pressure, heat and pressure, etc., to provide a copy or a print.

As methods for developing electrostatic latent images, there have been known the cascade development method, the magnetic brush development method and the pressure development method, for example. Further, there has been also known a method wherein a magnetic toner carried on a rotating sleeve containing a fixed magnet therein is caused to fly from the sleeve onto a photosensitive member.

A mono-component development scheme can provide a lighter and smaller-sized developing apparatus because it does not require carrier particles, such as ferrite particles, as required in a two-component development scheme. Further, the two-component development scheme requires devices for detecting a toner concentration and for replenishing the toner as required in order to keep a constant toner concentration in the two-component developer, so that the developing apparatus therefor is liable to be enlarged and heavy. The mono-component development scheme does not require such additional devices and can allow a smaller-sized and lighter developing apparatus.

In recent years, there is an increasing demand for color image forming ability in a copying machine, a printer, a facsimile apparatus, utilizing electrophotography.

Color toners are generally non-magnetic color toners because it is difficult to provide a required color hue with a magnetic color toner containing a magnetic material.

A non-magnetic color toner and a magnetic black toner are liable to provide a difference of gloss in the resultant images, so that a color image formed with a mixture of a non-magnetic color toner and a magnetic black toner is liable to provide a lower image quality. Toners characterized by their viscoelasticities have been disclosed in Japanese Laid-Open Patent Application (JP-A) 63-259575, JP-A 63-296065 and JP-A 3-231757. Toners disclosed in these publications have exhibited insufficient fixability and provided insufficient gloss for multi-color or full-color image formation when fixed in an oil-less heat and pressure fixing device. In such simultaneous fixation of a magnetic black toner and a non-magnetic color toner according to the oil-less fixation scheme, it is important to provide a good balance of image gloss without causing offset.

As a conventional fixing means for forming multi-color or full-color images, a heat-pressure fixing device equipped with an oil applicator has been used, for example, as shown in FIG. 12. Referring to FIG. 12, a heating roller 29 as a heating means may comprise, e.g., an aluminum core metal coated successively with an RTV (room temperature vulcanization-type) silicone rubber layer, a fluorine-containing rubber layer and an HTV (high temperature vulcanization type) silicone rubber layer.

On the other hand, a pressure roller 30 as a pressure application means may comprise, e.g. an aluminum core metal coated successively with an RTV silicone rubber layer, a fluorine-containing rubber layer and an HTV silicone rubber layer.

The heating roller 29 is equipped with a halogen heater 36 as a heating means, and the pressure roller 30 is similarly equipped with a halogen heater 37 disposed within the core metal so as to allow heating from both sides. Oil is applied onto the heating roller 29 by means of an oil applicator O. In the oil applicator O, dimethylsilicone oil 41 in an oil pan 40 is taken up by an oil scooping roller 42 an oil application roller 43 to apply the oil onto the heating roller while controlling the oil application amount by an adjusting blade 44. Such a heat-pressure fixing device equipped with an oil applicator provides an advantage that offset is well suppressed but provides a difficulty that the fixed image is liable to be solid with the oil. Moreover, the inclusion of an oil applicator results in a larger fixing device.

Accordingly, it is desired to provide an image forming method capable of forming high-quality multi-color or full-color fixed images according to the oil-less fixation scheme.

SUMMARY OF THE INVENTION

A generic object of the present invention is to provide a magnetic black toner and a multi-color or full-color image forming method having solved the above-mentioned problems.

A more specific object of the present invention is to provide a magnetic black toner and a multi-color or full-color image forming method capable of forming high-quality images with a moderate degree of gloss through easy adjustment of the gloss.

Another object of the present invention is to provide a magnetic black toner showing a good transferability to leave little transfer residual toner and less liable to cause transfer dropout even in the roller transfer scheme, and a multi-color or full-color image forming method using the toner.

A further object of the present invention is to provide a magnetic black toner capable of preventing back-transfer under a wide transfer current condition and providing a high transfer efficiency, and a multi-color or full-color image forming method using the toner.

A further object of the present invention is to provide a magnetic black toner exhibiting excellent releasability and slippage characteristic and causing little abrasion of the photosensitive member even after a long period of image formation on a large number of sheets, and a multi-color or full-color image forming method using the toner.

Another object of the present invention is to provide a magnetic black toner free from or less liable to cause charging abnormality or image defects due to soiling of members pressed against the image bearing member, and a multi-color or full-color image forming method using the toner.

A further object of the present invention is to provide an image forming method for forming a multi-color or full-color image having a good balance of gloss by using a magnetic black toner, a non-magnetic cyan toner, a non-magnetic yellow toner and a non-magnetic magenta toner.

According to the present invention, there is provided a magnetic black toner for developing an electrostatic latent image, comprising: (a) magnetic black toner particles containing a binder resin, a magnetic material and a first solid wax, and (b) inorganic fine powder, wherein (i) the magnetic material is contained in 30–200 wt. parts per 100 wt. parts of the binder resin, (ii) the first solid wax provides a DSC heat-absorption main peak in a range of 60°–120° C., (iii) the first solid wax shows a ratio Mw/Mn between weight-average molecular weight (Mw) and number-average molecular weight (Mn) of 1.0–2.0, (iv) the binder resin has a THF (tetrahydrofuran)-insoluble content of at most 5 wt. %, (v) the binder resin contains a THF-soluble content providing a GPC chromatogram showing a molecular weight distribution including a content (M1) at 40–70% of components having molecular weights of below $5\times10^4$, a content (M2) at 20–45% of components having molecular weights of $5\times10^4$–$5\times10^5$, and a content (M3) at 2–25% of components having molecular weights exceeding $5\times10^5$, satisfying M1≧M2>M3, and (vi) the magnetic black toner exhibits viscoelasticity characteristics including a value C of tan δ at 100° C. and a value D of tan δ at 150° C. giving a ratio D/C of at least 1.0, and a minimum (Emin) and a maximum (Emax) of tan δ within a temperature range of 150°–190° C. falling in a range of 0.5–3.0.

According to the present invention, there is further provided a multi-color or full-color image forming method, comprising:

(1) developing an electrostatic latent image with a developer comprising a non-magnetic yellow toner to form a yellow toner image on an image bearing member, and then transferring the yellow toner image onto a transfer-receiving material via or without via an intermediate transfer member, (2) developing an electrostatic latent image with a developer comprising a non-magnetic magenta toner to form a magenta toner image on an image bearing member, and then transferring the magenta toner image onto a transfer-receiving material via or without via an intermediate transfer member, (3) developing an electrostatic latent image with a developer comprising a non-magnetic cyan toner to form a cyan toner image on an image bearing member, and then transferring the cyan toner image onto a transfer-receiving material via or without via an intermediate transfer member, (4) developing an electrostatic latent image with the above-mentioned magnetic black toner to form a magnetic black toner image on an image bearing member, and then transferring the magnetic black toner image onto a transfer-receiving material via or without via an intermediate transfer member, and (5) fixing under application of heat and pressure the yellow toner image, the magenta toner image, the cyan toner image and the magnetic black toner image on the transfer-receiving material by means of a heat-pressure fixation device not equipped with an oil applicator to form a multi-color or full-color image on the transfer-receiving material.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
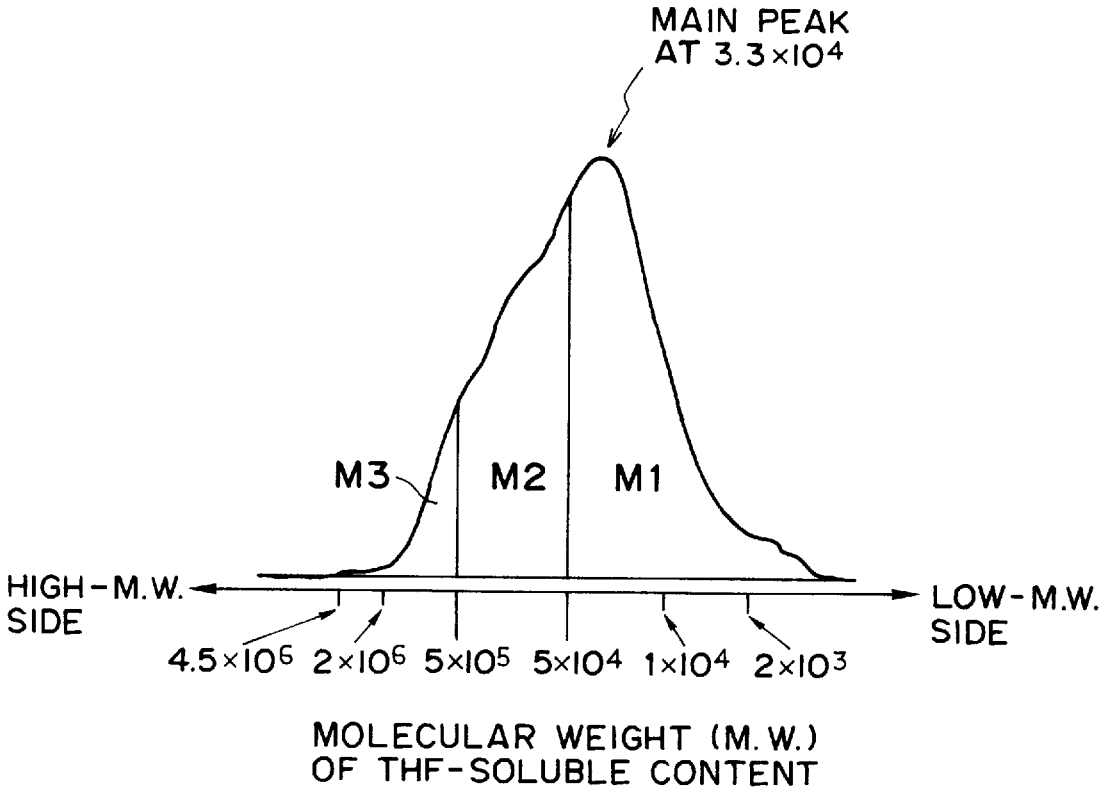
FIG. 1 is a chart representing a GPC chromatogram of a toner THF-soluble content.

The binder resin of the magnetic black toner according to the present invention has a THF (tetrahydrofuran)-insoluble content of at most 5 wt. % and contains a THF-soluble content providing a GPC chromatogram showing a molecular weight distribution including a content (M1) at 40–70% (areal percentage on the GPC chromatogram), of components having molecular weights of below $5\times10^4$, a content (M2) at 20–45% of components having molecular weights of $5\times10^4$–$5\times10^5$, and a content (M3) at 2–25% of components having molecular weights exceeding $5\times10^5$, satisfying M1≧M2>M3.

In case where the content (M1) of the components having molecular weights of below $5\times10^4$ is below 40%, the low-temperature fixability of the magnetic black toner is lowered. On the other hand, if the content (M1) exceeds 70%, the anti-high-temperature offset characteristic and the continuous image formation characteristic on a large number of sheets are lowered.

If the content (M3) of the component having molecular weights exceeding $5\times10^5$ is below 2%, the anti-high-temperature offset characteristic and the continuous image formation characteristic on a large number of sheets are lowered and, in excess of 25%, the low-temperature fixability is lowered.

The magnetic toner having a content (M2) at 25–45% of the components having molecular weights of $5\times10^4$–$50\times10^4$ and satisfying M1≧M2>M3 allows easy control of gloss and can provide a high-quality fixed image having an appropriate degree of gloss, thus providing a broad fixable temperature range and an excellent image gloss in combination.

The molecular weight distribution of the THF-soluble content of a binder resin may be determined based on a chromatogram obtained by gel permeation chromatography (GPC). More specifically, the GPC measurement may be performed by subjecting a sample toner to 20 hours of extraction with THF (tetrahydrofuran) solvent by means of a Soxhlet's extractor, and subjecting the resultant THF solution to GPC molecular weight-distribution measurement by using a succession of columns of A-801, 802, 803, 804, 805, 806 and 807 with reference to a calibration curve obtained based on standard polystyrene resin samples.

The THF-soluble content of the binder resin may preferably provide a ratio Mw/Mn of 2–100 between weight-average molecular weight (Mw) and number-average molecular weight (Mn).

The binder resin may preferably have an acid value of 2–30 mgKOH/g, more preferably 5–25 mgKOH/g, so as to provide improved charging stability and transferability to the resultant toner.

The binder resin of the magnetic toner may preferably have a glass transition point (Tg) of 50°–75° C., more preferably 52°–70° C., in view of the fixability and storability.

The glass transition point Tg of a binder resin may be determined based on a DSC curve obtained by using a high-accuracy internal heating input compensation-type differential scanning calorimeter (e.g., "DSC-7", available from Perkin-Elmer Corp.).

The magnetic toner of the present invention is characterized by viscoelasticity characteristics including a value C of tan δ at 100° C. and a value D of tan δ at 150° C. giving a ratio D/C of at least 1.0, and a minimum (Emin) and a maximum (Emax) of tan δ within a temperature range of 150°–190° C. falling in a range of 0.5–3.0. By satisfying the D/C value, Emin and Emax within the above-described ranges, the resultant toner can provide a moderate image gloss over a broad fixable temperature range even in the oil-less fixation system and also satisfactory image formation performance on a large number of sheets.

In case where the D/C ratio is below 1, Emax exceeds 3.0 or Emin is below 0.5, a good balance between the gloss and the fixable temperature range cannot be attained, and it becomes difficult to also satisfy a good continuous image formation performance on a large number of sheets. If Emin and Emax are in the range of 1.0–2.0, the above-mentioned properties are further improved. The viscoelasticity values including tan δ may be measured by using a visco-elasticity measurement apparatus (e.g., "Rheometer PDA-II", available from Rheometrics Co.) equipped with 25 mm-dia. parallel plates as shearing means at a measurement frequency of 6.28 radian/sec and a temperature-raising rate of 1° C./min in a measurement temperature range of 80° C. to 200° C.

The magnetic toner according to the present invention contains a wax (first solid wax) which is solid at room temperature and provides a DSC curve showing a heat-absorption main-peak temperature of 60°–120° C., preferably 80°–110° C. In case where the wax fails to provide a heat-absorption main peak in the temperature range of 60°–120° C., good fixability characteristics as described above cannot be attained in the oil-less fixation system.

By using a binder resin providing the above-mentioned molecular weight distribution and viscoelasticity characteristics in combination with such a wax, it becomes possible to provide a magnetic toner capable of providing a good combination of fixability and continuous image formation characteristics without impairing the gloss of fixed magnetic toner image.

If the solid wax has a DSC heat-absorption main peak in the range of 60°–120° C., the wax can also have a heat absorption sub-peak at a temperature above 120° C. It is preferred to use a solid wax not showing a DSC heat-absorption sub-peak at a temperature below 60° C. A solid wax showing a DSC heat-absorption sub-peak at a temperature below 60° C. is liable to result in a magnetic toner providing a lower image density and having lower storability.

It is preferred that the magnetic black toner obtained by incorporating the wax having a DSC heat-absorption main peak in the range of 60°–120° C. in the magnetic black toner particles, also exhibits a DSC heat-absorption main peak in the range of 60°–120° C. on its DSC curve.

The solid wax used in the present invention has a very sharp molecular weight distribution as represented by a ratio Mw/Mn of 1.0 to 2.0 between the weight-average molecular weight (Mw) and number-average molecular weight (Mn) according to the GPC measurement. In the present invention, by using such a wax having a very sharp molecular weight distribution, it has become possible to realize good anti-low-temperature offset characteristic and anti-high-temperature offset characteristic in the oil-less fixing system, and also an improved anti-blocking characteristic. Further, by combining the above-mentioned binder resin and such a solid wax having a very sharp molecular weight distribution, it has become possible to provide a magnetic black toner showing a moderate gloss characteristic and good anti-offset characteristic in combination in the oil-less fixing system.

Wax molecular weight distribution

The molecular weight distribution of a wax may be measured by gel permeation chromatography (GPC) according to the following conditions.

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a sample at a concentration of 0.15 wt. %.

Based on the above GPC measurement, the molecular weight distribution of a sample is obtained once based on a calibration curve prepared by monodisperse polystyrene standard samples, and recalculated into a distribution corresponding to that of polyethylene using a conversion formula based on the Mark-Houwink viscosity formula.

The solid wax may preferably have a number-average molecular weight of 350–2000, more preferably 400–1000, in view of the dispersibility in the binder resin and in order to provide a magnetic black toner exhibiting good anti-low-temperature offset characteristic, anti-high-temperature offset characteristic, anti-blocking property, and continuous image formation performance on a large number of sheets.

Examples of the solid wax may include: low-molecular weight hydrocarbon wax consisting of carbon and hydrogen, long-chain alkyl alcohol wax having an OH group, long-chain alkyl carboxylic acid wax having a COOH group and ester wax.

More specifically, examples of the low-molecular weight hydrocarbon wax may include: petroleum waxes, such as paraffin wax, microcrystalline wax and petrolactam; low-molecular weight polyolefin waxes, such as low-molecular weight polyethylene wax; and polymethylene waxes, such as Fischer-Tropsh wax. Petroleum wax, and low-molecular weight polyolefin wax generally have a ratio Mw/Mn exceeding 2.0 so that they may e used after purification so as to provide a ratio Mw/Mn of 1.0–2.0 and a DSC heat-absorption main peak of 60°–120° C.

The long-chain alkyl alcohol wax may comprise a mixture of long-chain alkyl alcohols having a number of carbon atoms in the range of 20–200.

The long-chain alkylcarboxylic acid wax may comprise a mixture of long-chain alkylcarboxylic acids having a number of carbon atoms in the range of 20–200.

Examples of the ester wax may include: purified carnauba wax, purified candelilla wax, and wax consisting principally of ester compounds between long-chain alkyl alcohols having 15–45 carbon atoms and long-chain alkylcarboxylic acids having 15–45 carbon atoms. It is particularly preferred to use low-molecular weight polyethylene wax having a sharp molecular weight distribution in the magnetic black toner.

The solid wax may preferably be used in 0.5–8 wt. parts, more preferably 1–8 wt. parts, per 100 wt. parts of the binder resin in the magnetic black toner, so as to provide good anti-low-temperature offset characteristic, anti-high-temperature offset characteristic and gloss characteristic.

The DSC heat-absorption peak may be determined by using a differential scanning calorimeter ("DSC-7", available from Perkin-Elmer Corp.) according to ASTM D3418-82. A sample in an amount of 2–10 mg accurately weighed is placed on an aluminum pan and subjected to measurement in a temperature range of 30°–160° C. at a temperature-raising rate of 10° C./min. in a normal temperature-normal humidity environment in parallel with a blank aluminum pan as a reference.

Examples of the binder resin used in the magnetic black toner according to the present invention may include: polystyrene; homopolymers of styrene derivatives, such as poly-p-chlorostyrene and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; polyester resins; and epoxy resins.

Comonomers constituting styrene copolymers may also include: monocarboxylic acids and derivatives thereof having a double bond, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; and dicarboxylic acids and derivatives thereof having a double bond, such as maleic acid, butyl maleate, methyl maleate.

The styrene copolymer may preferably be in the form of a crosslinked styrene copolymer having a THF-insoluble content of at most 5 wt. %, more preferably at most 3 wt. %, most preferably at most 1 wt. %. Examples of the crosslinking agent may include: aromatic divinyl compounds, such as divinylbenzene and divinylnaphthalene; carboxylic acid esters having two double bonds, such as ethylene glycol diacrylate, ethylene glycol dimethacrylate, and 1,3-butanediol dimethacrylate; divinyl compounds, such as divinylaniline, divinyl ether, divinyl sulfide, and divinylsulfone; and compounds having three or more vinyl groups.

The "THF-insoluble content" of a binder resin constituting toner particles referred to herein means a weight percentage of an ultra-high molecular weight polymer component (substantially, a crosslinked polymer) which is insoluble in a solvent THF (tetrahydrofuran) within the resin composition constituting a toner, and may be defined as a value measured in the following manner.

About 1.0 g of a binder resin sample is weighed (at $W_1$ g) and placed in a cylindrical filter paper (e.g., "No. 86R" available from Toyo Roshi K.K.) and then subjected to extraction with 100–200 ml of solvent THF in a Soxhlet's extractor for 6 hours. The soluble content extracted with the solvent is dried first by evaporation of the solvent and then by vacuum drying at 100° C. for several hours, and weighed (at $W_2$ g). The THF-insoluble content (wt. %) of the binder resin is calculated as $[(W_1-W_2)/W_1]\times 100$.

Such a THF-insoluble content and a molecular weight distribution of a binder resin measured for the binder resin as a starting material can be changed through a melt-kneading step for producing toner particles. In such a case, it is necessary to determine a THF-insoluble content and a molecular weight distribution of a binder resin constituting toner particles.

The THF-insoluble content of a binder resin constituting toner particles can be recovered by subjecting a magnetic black toner to extraction with toluene in a Soxhlet's extractor to recover a toluene-soluble content and, after solidifying the extract, removing a THF-soluble content from the solidified extract.

The THF-soluble content of a binder resin constituting toner particles may be determined in the following manner.

About 1.0 g of a magnetic black toner sample is weighed (at $W_3$ g) and placed in a cylindrical filter paper (e.g., "No. 86R" available from Toyo Roshi K.K.) and then subjected to extraction with 100–200 ml of solvent THF in a Soxhlet's extractor for 6 hours. The soluble content extracted with the solvent is dried first by evaporation of the solvent and then by vacuum drying at 100° C. for several hours, and weighed (at $W_4$ g). The components other than the resin component, such as a magnetic material and pigment, are weighed or determined (at $W_5$ g) in advance. The THF-insoluble content (wt. %) is calculated as $[(W_3-(W_5+W_4))/(W_3-W_5)]\times 100$.

The binder resin used in the present invention may for example be produced through solution polymerization in an organic solvent by adding dropwise (or continuously or batchwise) thereto a monomer mixture including styrene monomer, maleic acid half ester, divinylbenzene and one or two or more species of radical polymerization initiator having a 10-hour half-life temperature (temperature giving a half-life of 10 hours) of at least 100° C. In this instance, a binder resin having a prescribed molecular weight distribution and a THF-insoluble content of at most 5 wt. % can be prepared by adjusting the amount of the crosslinking agent such as divinylbenzene, the species and amount of the radical polymerization initiator, the addition rate of the monomer mixture, the polymerization temperature, etc.

The acid value of a binder resin may be determined according to JIS K-0670 in the following manner.

A sample resin in an amount of 2–10 g is weighed into an Erlenmeyer flask having a volume of 200–300 ml and dissolved by adding ca. 50 ml of ethanol/benzene (=½) mixture. In case of poor solubility, a small amount of acetone may be added. The solution is titrated with a preliminarily standardized N/10-caustic patash-ethanol solution in the presence of a phenolphthalein indicator. From the amount of the caustic potash solution (KOH (ml)), the acid value (mgKOH/g) of the resin is calculated by the following formula:

$$\text{Acid value (mgKOH/g)} = \text{KOH (ml)} \times N \times 56.1/\text{sample weight},$$

wherein N denotes a factor of the N/10-caustic potash solution.

The magnetic material may comprise a metal oxide containing one or more elements such as iron, cobalt, nickel, copper, magnesium, manganese, aluminum and silicon. Among theses, it is preferred to use a magnetic material principally comprising iron oxide, which can further contain silicon, aluminum or another metal element, in view of the chargeability control of the resultant magnetic black toner. The magnetic material may preferably have a BET specific surface area according to nitrogen adsorption of 2–30 $m^2/g$, particularly 3–28 $m^2/g$. It is further preferred to use a magnetic material having a Mohs hardness of 5–7.

The magnetic material may preferably be in the form of particles having little shape anisotropy, e.g., having a shape of octahedral, hexahedral or sphere, in order to provide a high image density. The magnetic material may preferably have a number average particle size (diameter) of 0.05–1.0 μm, more preferably 0.1–0.6 μm, further preferably 0.1–0.4 μm.

The magnetic material may be used in 30–200 wt. parts, preferably 50–150 wt. parts, per 100 wt. parts of the binder resin. Below 30 wt. parts, the toner conveying force is liable to be lowered to result in a developer layer irregularity leading to an image irregularity when used in a developing apparatus utilizing a magnetic force for toner conveyance. Further, the resultant magnetic black toner is liable to have an excessive triboelectric chargeability to result in a lowering of image density. On the other hand, in excess of 200 wt. parts, the resultant toner is liable to have a lower fixability, thus making it difficult to provide a fixed image with an increased gloss.

The magnetic black toner particles may preferably have shape factors SF-1 and SF-2 satisfying the following conditions (1)–(3) in view of the continuous image forming performance, the transferability and cleanability:

(1) $110 \leqq SF\text{-}1 \leqq 180$, (2) $110 < SF\text{-}2 \leqq 140$, (3) giving a ratio B/A of at most 1.0, wherein A=SF-1-100 and B=SF-2-100.

The shape factors SF-1 and SF-2 referred to herein are based on values measured in the following manner. Sample particles are observed through a field-emission scanning electron microscope ("FE-SEM S-800", available from Hitachi Seisakusho K.K.) at a magnification of 1000, and 100 images of toner particles having a particle size (diameter) of at least 2 μm are sampled at random. The image data are inputted into an image analyzer ("Luzex 3", available from Nireco K.K.) to obtain averages of shape factors SF-1 and SF-2 based on the following equations:

$$SF\text{-}1=[(MXLNG)^2/AREA]\times(\pi/4)\times 100,$$

$$SF\text{-}2=[(PERIME)^2/AREA]\times(1/4\pi)\times 100,]$$

wherein MXLNG denotes the maximum length of a sample particle, PERIME denotes the perimeter of a sample particle, and AREA denotes the projection area of the sample particle.

The shape factor SF-1 represents the roundness of toner particles, and the shape factor SF-2 represents the roughness of toner particles.

Figure 9:
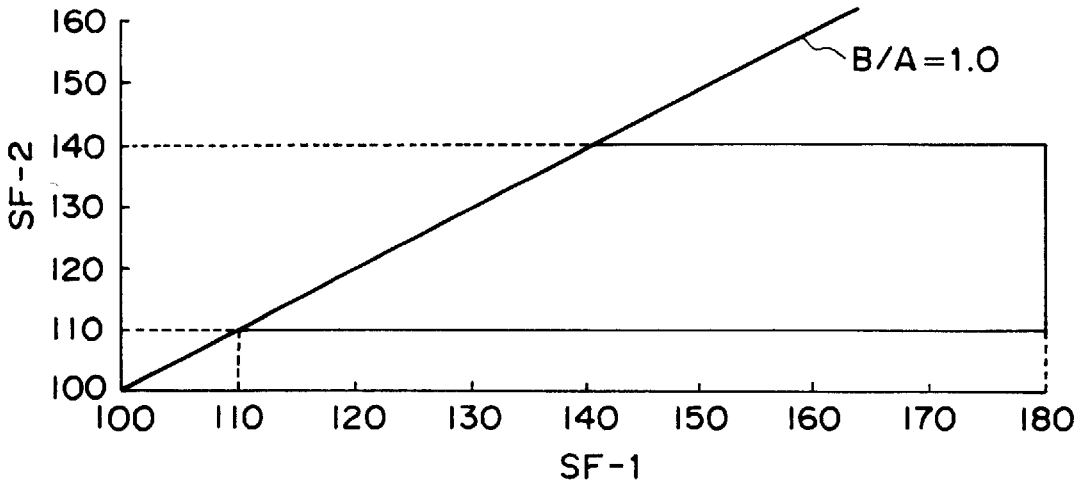
FIG. 9 is a graph showing a relationship between shape factors SF-1 and SF-2 of toners.

The ratio B/A=1 according to the condition (3) represents a solid slope line shown in FIG. 9, and the ratio B/A generally represents a slope of a line passing through the origin (SF-1=100 and SF-2=100) of a graph shown in FIG. 9. The ratio B/A may preferably be 0.2–0.9, more preferably 0.35–0.85 so as to provide a better transferability while retaining the developing performance. Further, owing to the inorganic fine powder present on the surface of magnetic toner particles, the transferability can be further improved and the transfer drop-out (or hollow character) of character or line images can be better prevented.

By satisfying the above-mentioned shape factors of toner particles in the present invention, in addition to the above effects, it has also become possible to provide a densely packed magnetic black toner image showing a better image smoothness and allowing a better control of gloss characteristic.

In order to provide a further better image quality by faithfully reproducing finer latent image dots, the magnetic toner particles may preferably have a weight-average particle size (diameter) of 4–8 μm. Toner particles having a weight-average particle size below 4 μm are liable to result in an increased amount of transfer residual toner on the photosensitive member or the intermediate transfer member and also liable to result in image ununiformity or irregularity due to fog and transfer failure. Toner particles having a weight-average particle size exceeding 8 μm are liable to cause scattering of character and line images.

The average particle size and particle size distribution a toner may be measured according to various methods by using a Coulter counter Model TA-II or Coulter Multisizer (respectively available from Coulter Electronics Inc.) etc., but values described herein are based on results obtained by using a Coulter Multisizer to which an interface for outputting a number-basis distribution and a volume-basis distribution (available from Nikkaki K.K.) and a personal computer ("PC9801" available from NEC K.K.) are connected, together with a 1%-NaCl aqueous solution as an electrolytic solution prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of at least 2 μm by using the above-mentioned Coulter Multisizer with a 100 μm-aperture to obtain a volume-basis distribution and a number-basis distribution. The weight-average particle size ($D_4$) and the number-average particle size ($D_1$) may be obtained from the volume-basis distribution and the number-basis distribution, respectively.

The magnetic black toner may preferably contain a charge control agent incorporated in (i.e., internally added to) toner particles or blended with (i.e., externally added to) toner particles. Such a charge control agent allows an optimum charge control for a particular developing system used, and particularly provides a further stabilized balance of particle size distribution and chargeability.

Examples of negative charge control agents may include: organometal complexes or chelate compounds, such as monoazo metal complexes, acetylacetone metal complexes, and metal complexes of aromatic hydroxycarboxylic acids and aromatic dicarboxylic acids. Other examples may include: aromatic hydroxycarboxylic acids, aromatic mono- and poly-carboxylic acids, and metal salts, anhydrides and esters of these, and phenol derivatives, such as bisphenols.

Examples of positive charge control agents may include: nigrosine and products of modification thereof with aliphatic acid metal salts, etc.; onium salts including quaternary ammonium salts, such as tributylbenzylammonium-1-hydroxy-4-naphthosulfonate and tetrabutylammonium tetrafluoroborate, and homologues thereof, such as phosphonium salts, and lake pigments of these, triphenylmethane dyes and lake pigments thereof (with laking agents, such as phosphotungstic acid, phosphomolybdic acid, phosphotungsticmolybdic acid, tannic acid, lauric acid, gallic acid, ferricyanates, and ferrocyanates), higher aliphatic acid metal salts; diorganotin oxides, such as dibutyltin oxide, dioctyltin oxide, and dicyclohexyltin oxide; and diorganotin borates, such as dibutyltin borate, dioctyltin borate and dicyclohexyltin borate.

These charge control agents may be used singly or in combination of two or more species.

The charge control agent may preferably be fine powdery one. More specifically, the charge control agent may preferably have a number-average particle size of at most 4 $\mu$m, particularly at most 3 $\mu$m. In case of the internal addition to the toner, the charge control agent may preferably be added in 0.1–20 wt. parts, particularly 0.2–10 wt. parts.

The first inorganic fine powder externally added to the magnetic black toner particles may comprise known ones, preferably selected from silica, alumina, titania and double or composite oxides of these in view of the charging stability, developing performance, flowability and storability. Silica is especially preferred. Silica may be either dry process silica (or fumed silica) produced by vapor phase oxidation of silicon halide or silicon alkoxide, or wet-process silica formed from alkoxide or water glass. However the dry-process silica is preferred because of less silanol group on the surface of or within silica particles and less production residues, such as $Na_2O$ or $SO_3^{2-}$. By using another metal halide, such as aluminum chloride or titanium chloride together with silica halide during the dry-process silica production, it is also possible to obtain composite fine powder of silica with another metal oxide.

The first inorganic fine powder may preferably have a number-average primary particle size of at most 30 nm and a specific surface area of at least 30 $m^2/g$, particularly 50–400 $m^2/g$, as measured by the BET method according to nitrogen adsorption. The first inorganic fine powder may be used in 0.1–8 wt. parts, preferably 0.5–5 wt. parts, further preferably 1.0–3.0 wt. parts, per 100 wt. parts of the magnetic black toner particles.

The number-average primary particle sizes of inorganic fine powder referred to herein are based on values measured by selecting 100 particles thereof having a particle size of at least 1 nm at random from electron microscopic photographs thereof (at a magnification of $10^5$ times) to measure the longest diameters for the respective particles and take an average thereof.

The specific surface area of the inorganic fine powder referred to herein are based on values measured by using an automatic gas adsorption measurement apparatus ("Autosorb 1", available from Yuasa Ionix K.K.) and nitrogen gas as an adsorbate according to the BET multi-point method.

The first inorganic fine powder may preferably have been surface-treated with a treating agent, such as silicon varnish, various modified silicone varnish, silicone oil, various modified silicone oil, silane coupling agent, silane coupling agent having a functional group, other organosilicone compounds and organotitanium compounds.

It is particularly preferred to use silica fine powder treated with silicone oil as the first inorganic fine powder in order to provide the magnetic black toner with an improved anti-high-temperature offset characteristic in the oil-less fixing system.

It is also a preferred mode to add a spherical second inorganic fine powder or resin fine powder having a number-average-primary particle size exceeding 30 nm (and preferably also a specific surface area of below 50 $m^2/g$), more preferably exceeding 50 nm (and also a specific surface area of below 30 $m^2/g$) in addition to the first inorganic fine powder in order to further improve the transferability and the cleanability. Examples thereof may include: spherical silica particles, spherical polymethylsiloxane particles and spherical resin fine particles.

The second inorganic fine powder and resin fine powder may preferably have a sphericity ($\psi$) of at least 0.90, defined as a ratio of a minimum length of diameter to a maximum length of diameter of a sample particle as measured in the following manner.

Sample fine powder particles are fixed on a collodion film held on copper mesh and photographed at a magnification of 1000 through an electron microscope ("H-700H", available from Hitachi Seisakusho K.K.) at an acceleration voltage of 100 kV. From the resultant photographs (at a magnification of 3000 including a printing magnification of 3), 100 particles are selected to provide an average of the sphericity ($\psi$) referred to herein.

It is also possible to externally add other additives within an extent of not substantially adversely affecting the performances of the magnetic black toner. Examples thereof may include: powdery lubricants, such as teflon powder, zinc stearate powder and polyvinylidene fluoride powder; abrasives such as cerium oxide powder, silicon carbide powder, and strontium titanate powder; and electroconductivity-imparting agents, such as carbon black powder, zinc oxide powder and tin oxide powder.

The magnetic black toner according to the present invention may be produced through known processes. For example, the binder resin, the wax, the metal salt or metal complex, the magnetic material and optional charge control agent and other additives may be sufficiently blended by a blender, such as a Henschel mixer or a ball mill, and then melt-kneaded by a hot-kneading means, such as hot rollers, a kneader or an extruder to mutually solubilize the resin and wax and disperse the magnetic material therein to form a melt-kneaded product, which is, after solidification by cooling, subjected to pulverization, classification and surface treatment (sphering). Either one of the classification and the surface treatment may be performed preceding to the other. The classification may preferably be performed by using a multi-division classifier utilizing the Coanda effect in view of the production efficiency.

The surface treatment (sphering) may be effected by subjecting pulverized toner particles to dispersion and heating in a hot water bath, to heating in a hot gas stream, or to application of mechanical impact energy. The mechanical impact application may preferably be performed at a temperature around the glass transition point Tg of the toner particles (e.g., Tg±10° C.) in view of agglomeration prevention and productivity. A temperature in a range of Tg±5° C. is preferred so as to reduce surface pores with a radius of 10 nm or larger and allow the inorganic fine powder to effectively function to provide an improved transferability.

It is also possible to effect the surface treatment (sphering) by coarsely crushing the melt-kneaded product after cooling and subjecting the crushed product to fine pulverization by means of a mechanical impact-type pulverizer to provide magnetic black toner particles having SF-1 and SF-2 within the specified ranges.

Figure 4:
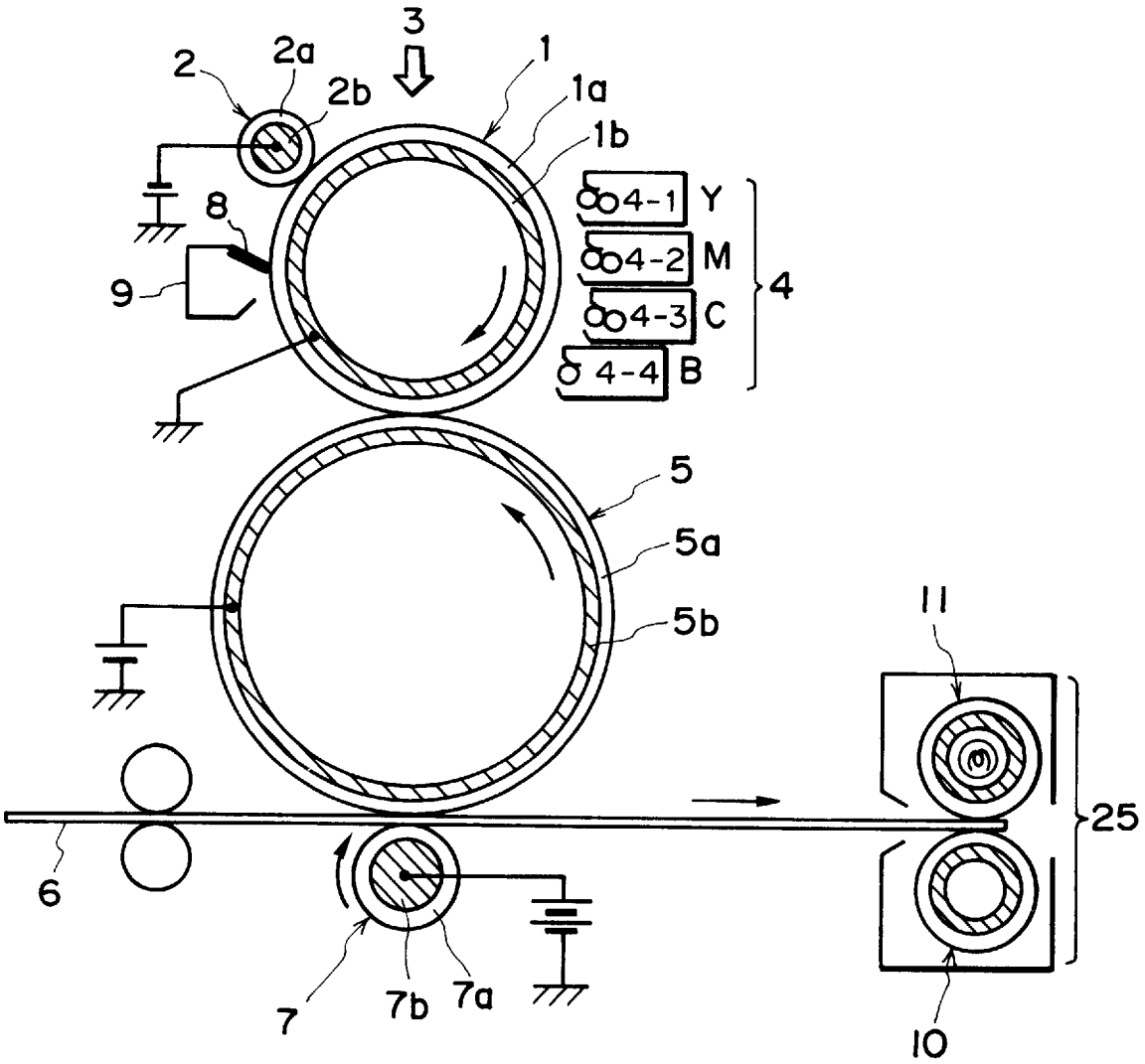
FIG. 4 is an illustration of a system for practicing an embodiment of the multi-color or full-color image forming method according to the invention.
Figure 5:
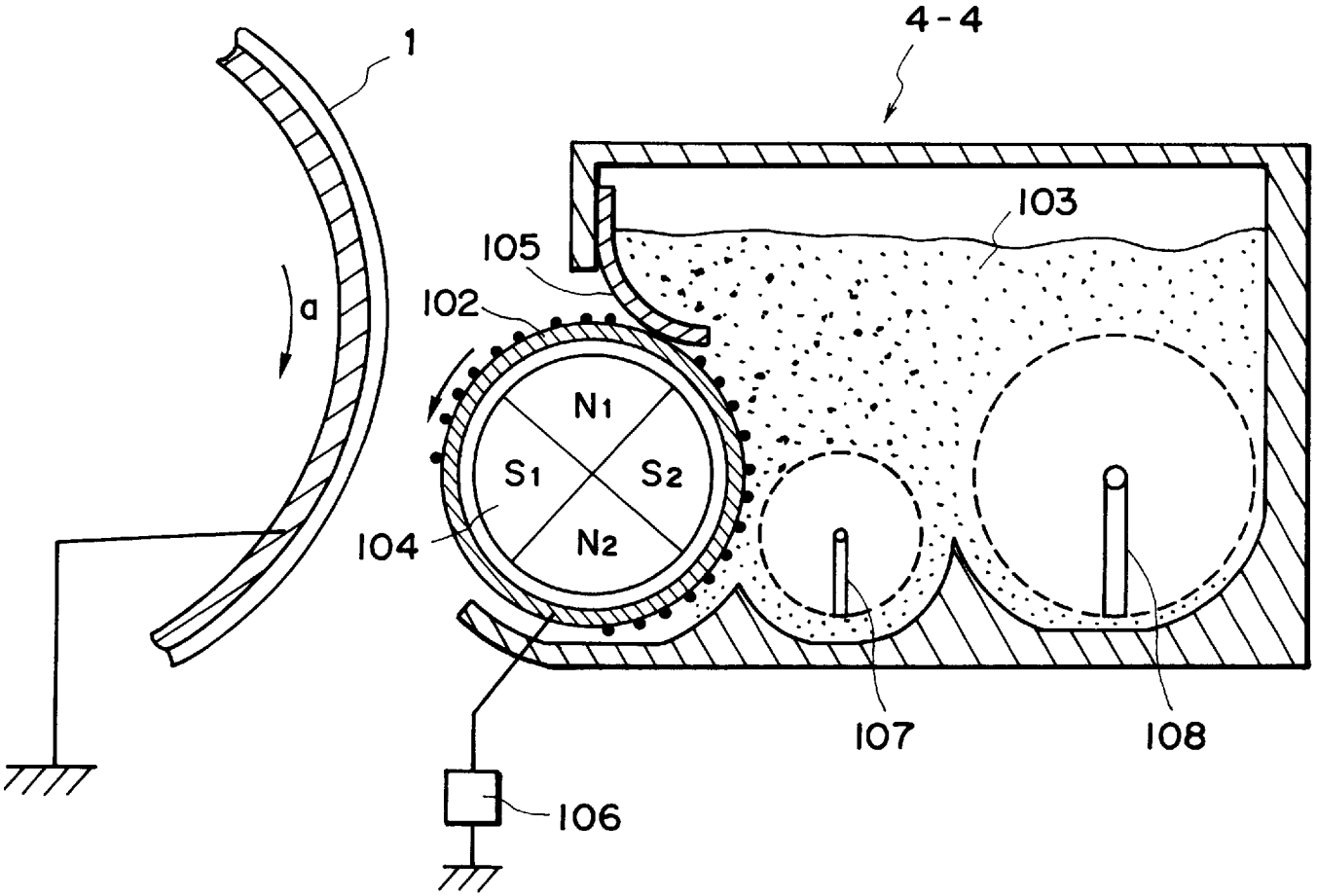
FIG. 5 is an illustration of a developing apparatus containing a magnetic black toner.
Figure 7:
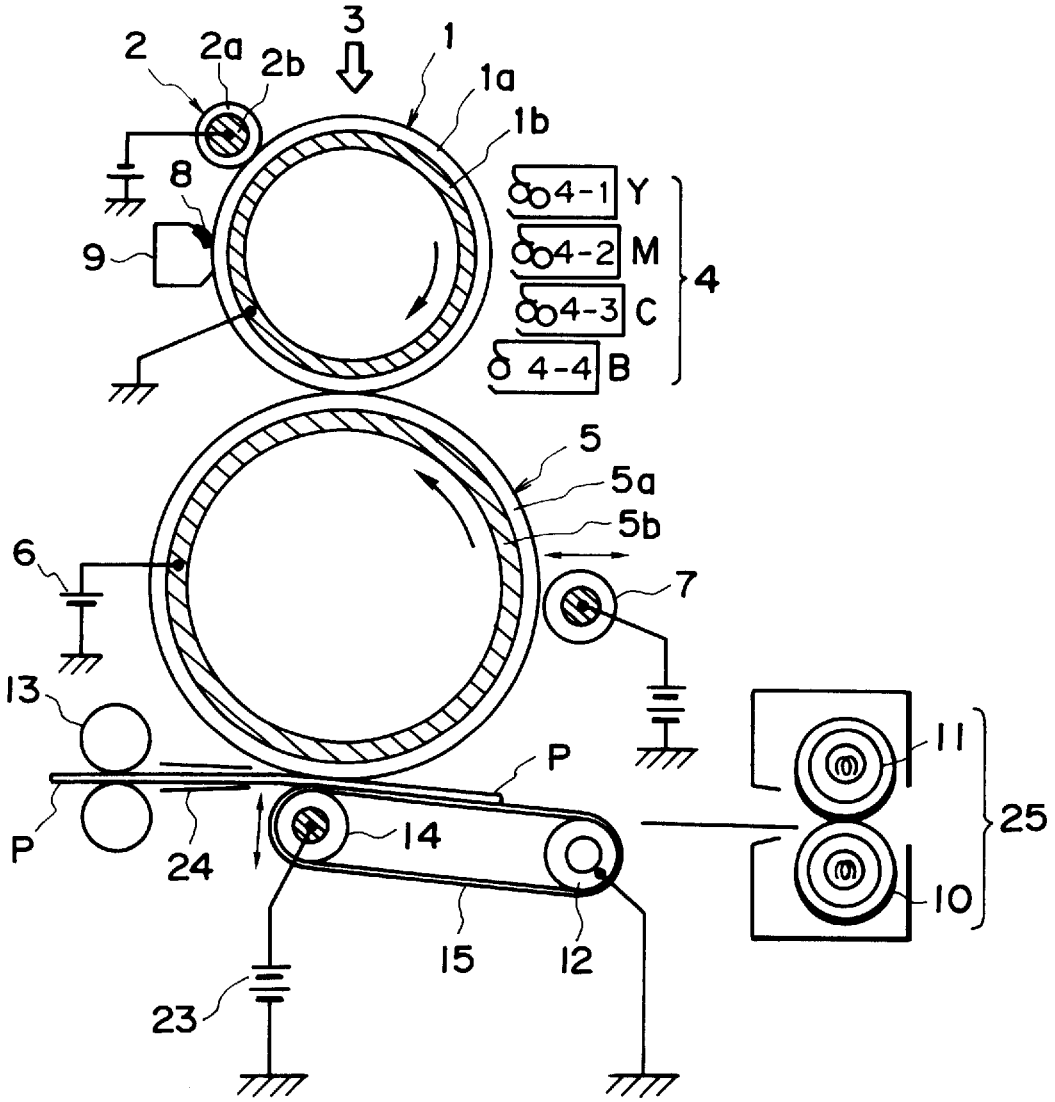
FIGS. 7 and 8 are respectively an illustration of a system for practicing an embodiment of the multi-color or full-color image forming method according to the invention.
Figure 8:
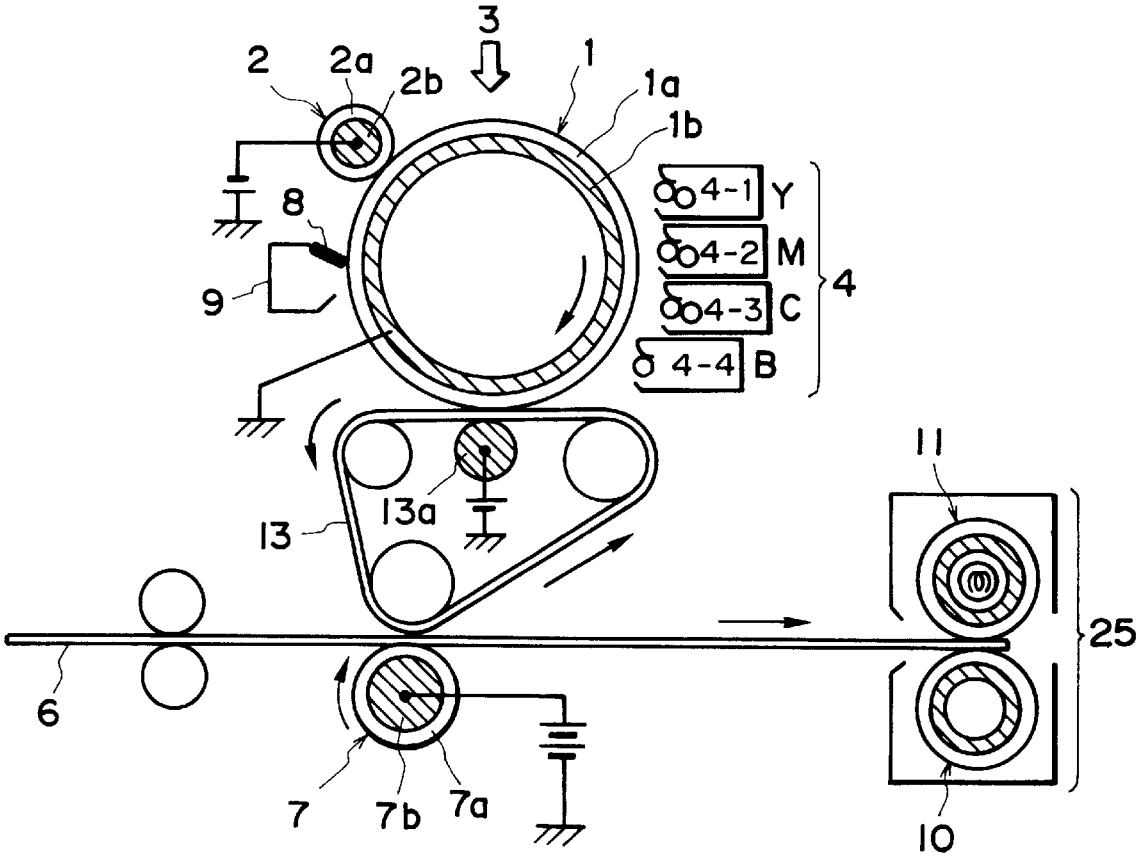

The magnetic black toner thus-obtained may for example be introduced into a developing apparatus 4-4 shown in FIG. 5 (which may be incorporated in an image forming apparatus as shown in FIGS. 4, 7 or 8), and used for developing a digital electrostatic latent image formed on an image bearing member 1. More specifically, the developing apparatus shown in FIG. 5 includes a magnetic black toner 103, a developing sleeve 102 formed of a on-magnetic metal, such as aluminum or stainless steel, a fixed magnet 104 enclosed within the developing sleeve, a first stirring bar 107 and a second stirring bar 108. The developing sleeve 102 can be surfaced with a resin layer containing electroconductive particles dispersed therein. The developing sleeve 102 may be supplied with a DC bias and an AC bias from a bias application means 106 to form an alternating electric field between the image bearing member 1 and the developing sleeve 102, under the action of which a digital electrostatic latent image on the image bearing member is developed with a layer of the magnetic black toner formed on the sleeve 102 according to the reversal development mode, thereby forming a magnetic black toner image on the image bearing member 1. The magnetic toner image formed on the image bearing member 1 may be transferred onto an intermediate transfer member 5 (or 13) as shown in FIGS. 4 or 7 (or 8), and then transferred from the intermediate transfer member 5 (or 13) to a transfer-receiving material 6 (or P), or may be transferred from the image bearing member 1 directly to such a transfer-receiving material.

By using the magnetic black toner according to the present invention as a black toner functioning as a contrast intensifier in multi-layer or full-color image formation according to the mono-component development mode, it becomes possible to provide a compact developing apparatus (as shown in FIGS. 4, 7 or 8) and also provide a black image with an improved image quality. Further, having excellent anti-offset characteristic and gloss characteristic, the magnetic black toner according to the present invention can provide a multi-color or full-color image even by the oil-less fixing system.

Next, explanation will be made on non-magnetic color toner (including a non-magnetic yellow toner, a non-magnetic magenta toner, and a non-magnetic cyan toner) used in connection with the magnetic black toner according to the present invention.

Figure 10:
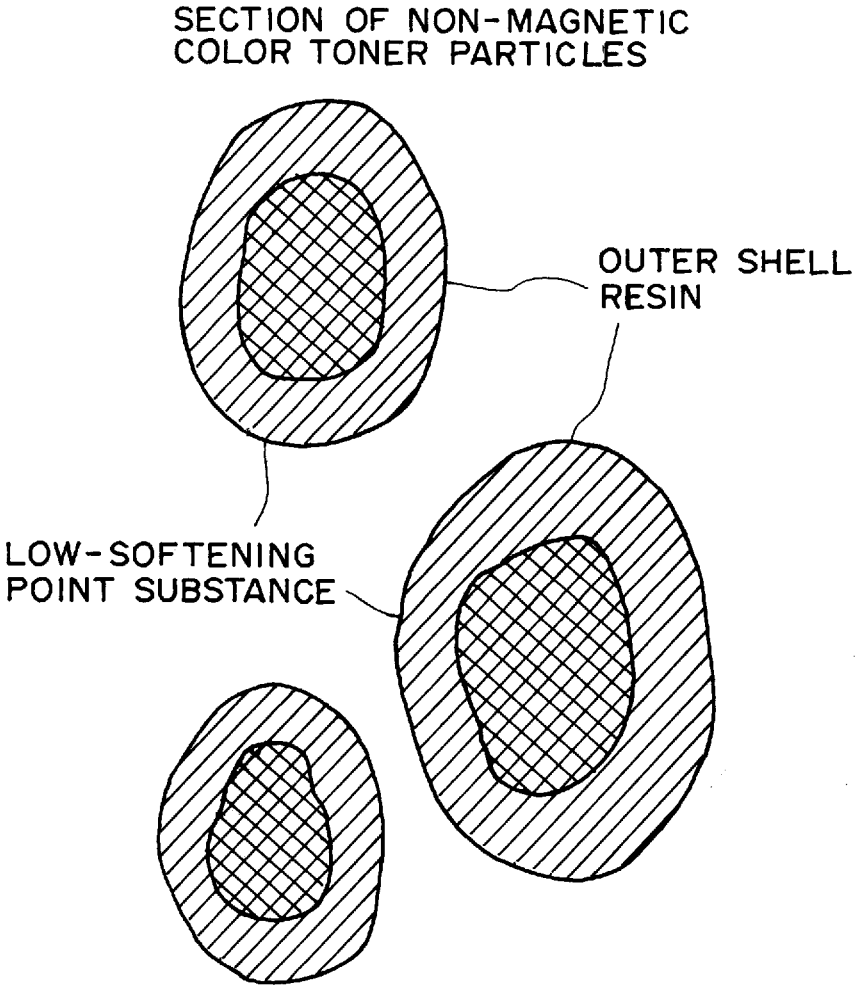
FIG. 10 is a sectional view of non-magnetic color toner particles.

Each non-magnetic color toner may preferably contain 5–40 wt. parts, particularly 12–35 wt. parts of a low-softening point substance (preferably a solid wax) having DSC heat-absorption main peak at a temperature in the range of 60°–120° C. per 100 wt. parts of the binder resin in order to exhibit good color mixability and anti-offset characteristic in the oil-less fixing system. The non-magnetic color toner particles may preferably be produced through a process wherein a polymerizable mixture is formed by adding to a polymerizable monomer an appropriate crosslinking agent and/or a resin component, a low-softening point substance and a polymerization initiator, dispersing the polymerizable mixture into droplets in an aqueous medium and polymerizing the droplets in the aqueous medium to form toner particles having an island/sea structure (including a core/shell structure) as shown in FIG. 10, wherein the low-softening substance is enclosed within an outer shell binder resin comprising the polymerizate in each toner particle.

Such an island/sea structure comprising a low-softening point substance with an outer shell binder resin may be formed, e.g., by a method of using a low-softening point substance having a small polarity than the principal monomer component together with a small amount of a resin or a monomer component having a larger polarity to form such a polymerizable mixture, and polymerizing droplets of the polymerizable mixture to form non-magnetic color toner particles having a core/shell structure wherein the low-softening point substance is coated with the binder resin. The polymerizate particles thus formed may be used as they are as non-magnetic color toner particles or polymerizate particles produced in a very fine particle size may be agglomerated up to a desired particle size to form toner particles having a multi-island/sea structure (or a multi-core/shell structure). In order to provide such an island/sea structure through the above-described method, it is preferred that at least one species of the low-softening point substance has a melting point (a DSC maximum heat-absorption peak temperature) that is lower than the polymerization temperature.

By enclosing the low-softening point substance within the non-magnetic color toner particles, each toner particle is allowed to contain a relatively large amount of low-softening point substance while suppressing a lowering of anti-blocking property of the color toner, and is allowed to form a non-magnetic color toner particle having a good impact resistance, and good low-temperature fixability and color mixability in hot-pressure fixation by using a low-softening point substance of sharp-melting characteristic.

The polymerizable monomer for providing a non-magnetic color toner through such a polymerization process may be a radially polymerizable vinyl-type monomer which may be either a monofunctional polymerizable monomer or a polyfunctional polymerizable monomer. Examples of the monofunctional polymerizable monomer may include: styrene and its derivatives, such as styrene, α-methylstyrene, β-methylstyrene, o-methylstyrene, m-methylstyrene, p-methylstyrene, 2,4-dimethylstyrene, p-n-hexylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers, such as methyl acrylate, ethyl acrylate, n-propyl acrylate, isopropyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphateethyl acrylate, dibutylphosphateethyl acrylate, and 2-benzoyloxyethyl acrylate; methacrylic polymerizable monomers, such as methyl methacrylate, ethyl methacrylate, n-propyl methacrylate, isopropyl methacrylate, n-butyl methacrylate iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphateethyl methacrylate, and dibutylphosphateethyl methacrylate; methylene aliphatic monocarboxylic acid esters; vinyl esters, such as vinyl acetate, vinyl propionate, vinyl benzoate, vinyl lactate, vinyl benzoate and vinyl formate; vinyl ethers, such as vinyl methyl ether, vinyl ethyl ether, and vinyl isobutyl ether; and vinyl ketones, such as vinyl methyl ketone; vinyl hexylketone and vinyl isopropyl ketone.

Examples of the polyfunctional polymerizable monomer may include: diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-(acryloxy-diethoxy)phenyl]-propane, trimethylpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxydiethoxy)phenyl]propane, 2,2'-bis[4-(methacryloxy-polyethoxy)phenyl]propane, trimethylolpropane trimethacrylate, tetramethylolmethane tetramethacrylate, divinylbenzene, divinylnaphthalene and divinyl ether.

The above-mentioned monofunctional polymerizable monomers may be used singly or in combination of two or more species thereof, or further in combination with one or more species of the polyfunctional polymerizable monomers, which can also function as a crosslinking agent.

The polymerization initiator used for polymerization of the above-mentioned polymerizable monomer may be an oil-soluble initiator and/or a water-soluble initiator. Examples of the oil-soluble initiator may include: azo compounds, such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide initiators, such as acetylcyclohexylsulfonyl peroxide, diisopropyl peroxycarbonate, decanoyl peroxide, lauroyl peroxide, stearoyl peroxide, propionyl peroxide, acetyl peroxide, t-butyl peroxy-2-ethylhexanoate, benzoyl peroxide, t-butyl peroxyisobutyrate, cyclohexanone peroxide, methyl ethyl ketone peroxide, dicumyl peroxide, t-butyl hydroperoxide, di-t-butyl peroxide, and cumeme hydroperoxide.

Examples of the water-soluble initiator may include: ammonium persulfate, potassium persulfate, 2,2'-azobis(N, N'-dimethyleneisobutyroamidine) hydrochloric acid salt, 2,2'-azobis(2-amidinopropane) hydrochloric acid salt, azobis(isobutylamidine) hydrochloric acid salt, sodium 2,2'-azobisisobutyronitrilesulfonate, ferrous sulfate and hydrogen peroxide.

In the present invention, it is possible to further add a chain transfer agent, a polymerization inhibitor, etc., in order to control the degree of polymerization of the polymerizable monomer.

The toner according to the present invention may particularly preferably be produced through the suspension polymerization process by which a particulate toner having a small particle size of 4–8 $\mu$m can be easily produced with a uniformly controlled shape and a sharp particle size distribution. It is also possible to suitably apply the seed polymerization process wherein once-obtained polymerizate particles are caused to adsorb a monomer, which is further polymerized in the presence of a polymerization initiator. It is also possible to include a polar compound in the monomer adsorbed by dispersion or dissolution.

In case where the toner according to the present invention is produced through the suspension polymerization, toner particles may be produced directly in the following manner. Into a polymerizable monomer, a low-softening point substance such as wax, a colorant, a polymerization initiator, a polar polymer such as a polyester, a crosslinking agent and another optional additive are added and uniformly dissolved or dispersed by a homogenizer or an ultrasonic dispersing device, to form a polymerizable monomer composition, which is then dispersed and formed into particles in a dispersion medium containing a dispersion stabilizer by means of an ordinary stirrer, a homomixer or a homogenizer preferably under such a condition that droplets of the polymerizable monomer composition can have a desired particle size of the resultant color toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50°–90° C., preferably 55°–85° C. The temperature can be raised at a later stage of the polymerization. It is also possible to subject a part of the aqueous system to distillation in a latter stage of or after the polymerization in order to remove the yet-unpolymerized part of the polymerizable monomer and a by-product which can cause an odor in the toner fixation step. After the reaction, the produced color toner particles are washed, filtered out, and dried. In the suspension polymerization, it is generally preferred to use 300–3000 wt. parts of water as the dispersion medium per 100 wt. parts of the monomer composition.

In production of non-magnetic color toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, and starch. These dispersion stabilizers may preferably be used in the aqueous dispersion medium in an amount of 0.2–2.0 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization. In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

Each non-magnetic color toner may preferably have a shape factor SF-1 of 100–160, more preferably 100–150, further preferably 100–125.

In the case of providing a non-magnetic color toner including a binder resin comprising principally a styrene copolymer, the THF-soluble content of the binder resin may preferably have a molecular weight distribution according to gel permeation chromatography providing a main peak in a molecular weight region of $3\times10^3$–$5\times10^4$ and a sub-peak or shoulder in a molecular weight region of at least $10^5$. It is further preferred to provide at least two in total of shoulder (s) and/or sub-peak(s) in the molecular weight region of at least $10^5$. The binder resin principally comprising a styrene copolymer may preferably contain a THF-insoluble content in an amount of 0.1–20 wt. %, more preferably 1–15 wt. %, so as to provide a good balance of gloss with the above-mentioned magnetic black toner.

It is also preferred to use a binder resin comprising a mixture of a styrene copolymer and a polyester resin. For example, it is preferred to use a combination of a crosslinked styrene copolymer and a non-crosslinked polyester resin, or a combination of a crosslinked styrene copolymer and a crosslinked polyester resin, so as to provide a non-magnetic color toner having good fixability, anti-offset characteristic and color mixability.

A polyester resin is excellent in fixability and transparency and is suitable for providing a color toner requiring a good color mixability. It is particularly preferred to use a crosslinked or non-crosslinked polyester resin formed by polycondensation of a bisphenol derivative of the following formula:

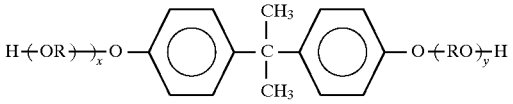

wherein R denotes an ethylene or propylene group, x and y are independently an integer of at least 1 with the proviso that the average of x+y is in the range of 2–10, or a substitution derivative thereof, as a diol component, with a carboxylic acid component selected from polycarboxylic acids having at least two carboxylic groups and their anhydrides and lower alkyl esters, such as fumaric acid, maleic acid, maleic anhydride, phthalic acid, terephthalic acid, trimellitic acid and pyromellitic acid.

The polyester resin may preferably have an acid value of 1–35 mgKOH/g, more preferably 1–20 mgKOH/g, further preferably 3–15 mgKOH/g so as to provide a toner showing stable chargeability in various environmental conditions.

The non-magnetic color toners may be prepared by using a yellow colorant, a magenta colorant and a cyan colorant, as described below, together with a binder resin as described above.

Examples of the yellow colorant may include: condensed azo compounds, isoindolinone compounds, anthraquinone compounds, azo metal complexes, methin compounds and acrylamide compounds. Specific preferred examples thereof may include C.I. Pigment Yellow 12, 13, 14, 15, 17, 62, 74, 83, 93, 94, 95, 97, 109, 110, 111, 120, 127, 128, 129, 147, 168, 174, 176, 180, 181 and 191.

Examples of the magenta colorant may include: condensed azo compounds, diketopyrrolepyrrole compounds, anthraquinone compounds, quinacridone compounds, basic dye lake compounds, naphthol compounds, benzimidazole compounds, thioindigo compounds and perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basic dye lake compounds. Specific preferred examples thereof may include: C.I. Pigment Blue 1, 7, 15, 15:1, 15:2, 15:3, 15:4, 60, 62, and 66.

These chromatic colorants may be used singly, in mixture of two or more species or in a state of solid solution. The above colorants may be appropriately selected in view of hue, color saturation, color value, weather resistance, OHP transparency, and a dispersibility in toner particles. These chromatic colorants may preferably be used in a proportion of 1–20 wt. parts per 100 wt. parts of the binder resin.

The low-softening point substance used for constitutes a non-magnetic color toner may comprise a solid wax similar to the one used in the magnetic black toner. As the low-softening substance for providing a non-magnetic color toner, it is preferred to use a solid wax providing a DSC heat-absorption curve showing a heat-absorption main peak in a temperature range of 60°–90° C., more preferably 60°–85° C. It is further preferred to use a solid wax of a sharp melting characteristic as represented by a heat-absorption main giving a half-value width of at most 10° C., more preferably at most 5° C. It is particularly preferred to use an ester wax principally comprising ester compounds formed from long-chain alkyl alcohol(s) having 15–45 carbon atoms and long-chain alkylcarboxylic acid(s) having 15–45 carbon atoms.

An embodiment of the image forming method according to the present invention will now be described with reference to FIG. 4.

In an image forming apparatus system shown in FIG. 4, developing apparatus 4-1, 4-2, 4-3 and 4—4 are caused to contain a developer comprising a yellow toner, a developer comprising a magenta toner, a developer comprising a cyan toner, and a developer comprising a magnetic black toner, respectively, so as to develop electrostatic latent images formed on a photosensitive member 1 as an image bearing member according to a non-magnetic mono-component developing scheme or a magnetic jumping developing scheme, thereby sequentially forming respective color toner images on the photosensitive member. The photosensitive member 1 may be in the form of a photosensitive drum as shown (or a photosensitive belt (not shown)) having an insulating photoconductor layer 1*b* comprising, e.g., amorphous selenium, cadmium sulfide, zinc oxide, organic photoconductor or amorphous silicon formed on an electroconductive substrate 1*a*. The photosensitive member 1 is rotated in an indicated arrow direction by a drive means (not shown). The photosensitive member 1 may preferably comprise an amorphous silicon photosensitive layer or OPC photosensitive layer.

The organic photosensitive layer may be composed of a single layer comprising a charge-generating substance and a charge-transporting substance or may be function-separation type photosensitive layer comprising a charge generation layer and a charge transport layer. The function-separation type photosensitive layer may preferably comprise an electroconductive support, a charge generation layer, and a charge transport layer arranged in this order.

The organic photosensitive layer may preferably comprise a binder resin, such as polycarbonate resin, polyester resin or acrylic resin, because such a binder resin is effective in providing an improved cleaning characteristic and is not liable to cause melt-sticking or filming of toner onto the photosensitive member.

A charging step may be performed by using a corona charger which is not in contact with the photosensitive member 1 or by using a contact charger, such as a charging roller. The contact charging as shown in FIG. 4 may preferably be used in view of efficiency of uniform charging, simplicity and a lower ozone-generating characteristic.

The charging roller 2 comprises a core metal 2*b* and an electroconductive elastic layer 2*a* surrounding a periphery of the core metal 2*b*. The charging roller 2 is pressed against the photosensitive member 1 at a prescribed pressure (pressing force) and rotated mating with the rotation of the photosensitive member 1.

The charging step using the charging roller may preferably be performed under process conditions including an applied pressure of the roller of 5–500 g/cm, an AC voltage of 0.5–5 kvpp, an AC frequency of 50–5 kHz and a DC voltage of ±0.2–±5 kV in the case of applying AC voltage and DC voltage in superposition.

Other charging means may include those using a charging blade or an electroconductive brush. These contact charging means are effective in omitting a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF), polyvinylidene chloride (PVDC) or fluorinated acrylic resin.

A toner image formed on the photosensitive member 1 may be transferred onto a drum-shaped intermediate transfer member 5 supplied with a transfer voltage of, e.g., ±0.1–±5 kV (or a belt-shaped intermediate transfer member 13 supplied with a transfer bias voltage from a bias means 13*a* as shown in FIG. 8). The intermediate transfer member 5 comprises a pipe-like electroconductive core metal 5*b* and a medium resistance-elastic layer 5*a* (e.g., an elastic roller) surrounding a periphery of the core metal 5*b*. The core metal 5*b* can also comprise a plastic pipe coated by electroconductive plating.

The medium resistance-elastic layer 5*a* may be a solid layer or a foamed material layer in which an electroconductivity-imparting substance, such as carbon black, zinc oxide, tin oxide or silicon carbide, is mixed and dispersed in an elastic material, such as silicone rubber, teflon rubber, chloroprene rubber, urethane rubber or ethylene-propylene-diene terpolymer (EPDM), so as to control an electric resistance or a volume resistivity at a medium resistance level of $10^5$–$10^{11}$ ohm·cm.

The intermediate transfer member 5 is born on a shaft parallel to the photosensitive member 1 and disposed in contact with a lower surface port of the photosensitive member 1 so as to be rotatable in a counterclockwise direction indicated by an arrow at an identical peripheral speed as the photosensitive member 1.

When a first color toner image on the photosensitive member 1 passes through a transfer nip where the photosensitive member 1 and the intermediate transfer member are abutted to each other, the first toner image is transferred onto the intermediate transfer member under the action of an electric field formed by a transfer bias voltage applied to the intermediate transfer member 5.

A transfer roller 7 as a transfer means is supported on a shaft parallel to the intermediate transfer member 5 and disposed contactable to a lower surface of the intermediate transfer member 5. The transfer roller 7 is rotated in a clockwise direction indicated by an arrow. The transfer roller 7 may be disposed contactable to the intermediate transfer member 5 directly as shown in FIG. 5 or via a transfer belt 12 as shown in FIG. 7.

The transfer roller basically comprises a core metal 7*b* and an electroconductive elastic layer 7*a* covering the outer periphery of the core metal 7*b*.

The intermediate transfer member and transfer means can comprise an ordinary material. If the transfer means is set to have a lower volume resistivity than the intermediate transfer member, the application voltage to the transfer means can be alleviated, whereby a good toner image can be formed on the transfer-receiving material and the winding of the transfer-receiving material about the intermediate transfer member can be prevented. It is particularly preferred that the elastic layer of the intermediate transfer member has a volume resistivity at least ten times that of the elastic layer of the transfer means.

The hardness of the elastic layers of the intermediate transfer member and the transfer means may be determined according to JIS K-6301. More specifically, the intermediate transfer member may preferably comprise an elastic layer having a hardness in the range of 10–40 deg. On the other hand, the transfer means may preferably comprise an elastic layer having a hardness of 41–80 deg. representing a higher hardness than that of the intermediate transfer member, so as to prevent the wining of a transfer-receiving material about the intermediate transfer member. If the intermediate transfer member is softer than the transfer means, a recess may be formed preferentially on the side of the intermediate transfer member, whereby the winding of the transfer-receiving material onto the intermediate transfer member can be prevented.

The transfer roller 7 may be rotated at a peripheral speed identical to or different from that of the intermediate transfer member 5. When a transfer-receiving material is conveyed to a nip between the intermediate transfer member 5 and the transfer roller 7, a bias voltage of a polarity opposite to that of the triboelectric charge of the toner image is applied to the transfer roller to transfer the toner image on the intermediate transfer member 5 onto the surface of the transfer-receiving material 6.

The transfer roller 7 may comprise a similar material as the charging roller 2. More specifically, the transfer roller 7 may have an electroconductive elastic layer 7*a* which is a solid or foamed layer comprising an elastic material such as polyurethane rubber or EPDM containing an electroconductivity-imparting agent such as carbon black, zinc oxide or silicon carbide to provide a medium level of volume resistivity on the order of $10^6$–$10^{10}$ ohm·cm.

Preferred transfer process conditions may include: a transfer roller abutting pressure of 2.94–490 N/m (3–500 g/cm), more preferably 19.6–294 N/m and a DC voltage of ±0.2–±10 kV. In the above-mentioned abutting linear pressure range, difficulties, such as deviation of the transfer-receiving material during conveyance and transfer failure, are not likely to occur.

Then, the transfer-receiving material 6 carrying the transferred toner image is conveyed to an oil-less fixing device 25 comprising basically a heating roller 11 containing therein a heat-generating member such as a halogen heater but not equipped with an oil applicator and an elastic pressure roller 10 pressed against the heating roller and the toner image is fixed onto the transfer-receiving material 6 while being passed through the heating roller an the pressure roller. It is also possible to effect an oil-less fixation by using a system where the toner image is heated via a film and pressed against the transfer-receiving material.

More specifically, the development an multi-color or full-color image formation on the photosensitive member (image bearing member) 1 may be performed in the following manner.

In the course of rotation, the photosensitive member 1 is uniformly charged to prescribed polarity and potential by the primary charging roller 2 and then exposed to image light 3 from an unshown imagewise exposure means (e.g., a system for color separation of a color original image and focusing exposure, or a scanning exposure system including a laser scanner for outputting a laser beam modified corresponding to time-serial electrical digital image signals based on image data) to form an electrostatic latent image corresponding to a first color component image (e.g., yellow image) of the objective color image.

Then, the electrostatic latent image is developed with a yellow toner 20 (as a first color toner) in a first developing device 4-1. The developing device 4-1 constitutes an apparatus unit which is detachably mountable to a main assembly of the image forming apparatus, and an enlarged view thereof is shown in FIG. 6.

Figure 6:
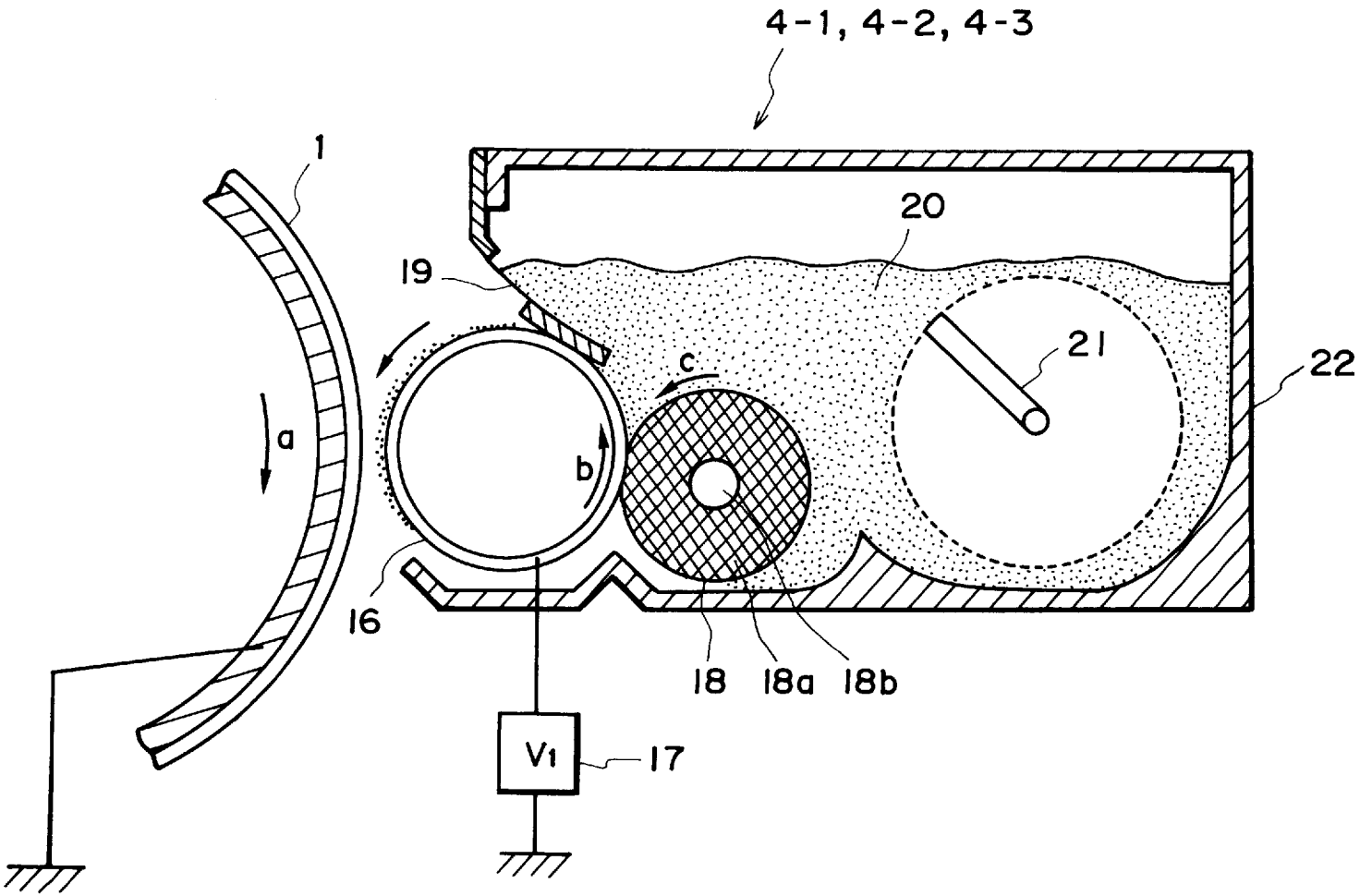
FIG. 6 is an illustration of a developing apparatus containing a non-magnetic color toner.

Referring to FIG. 6, the developing device 4-1 includes an outer wall or casing 22 enclosing a mono-component non-magnetic yellow toner 20. Being half enclosed within the outer wall 22, a developing sleeve 16 (as a toner-carrying member) is disposed opposite to the photosensitive member 1 rotating in an indicated arrow a direction and so as to develop the electrostatic image on the photosensitive member 1 with the toner carried thereon, thereby forming a toner image on the photosensitive member 1. As shown in FIG. 6, a right half of the developing sleeve 16 is protruded and enclosed in the outer wall 22 and a left half thereof is exposed out of the outer wall 22 and disposed in a lateral position with the photosensitive member 1 and so as to be movable in an indicated arrow b direction while facing the photosensitive member 1. A small gap is left between the developing sleeve 16 and the photosensitive member 1.

The toner-carrying member need not be in a cylindrical form like the developing sleeve 16, but can be in an endless belt form driven in rotation or composed of an electroconductive rubber roller.

In the outer wall 22, an elastic blade 19 (as an elastic regulation member) is disposed above the developing sleeve 16, and a toner application roller 18 is disposed upstream of the elastic blade 19 in the rotation direction of the developing sleeve 16. The elastic regulation member can also be an elastic roller.

The elastic blade 19 is disposed with a downward inclination toward the upstream side of the rotation direction of the developing sleeve, and abutted counterdirectionally against an upper rotating peripheral surface of the developing sleeve.

The toner application roller 18 is abutted rotatably against a side of the developing sleeve 16 opposite to the photosensitive member 1.

In the developing device 4-1 having the above-described structure, the toner application roller 18 is rotated in an arrow c direction to supply the yellow toner 20 to the vicinity of the developing sleeve 16 and, at an abutting position (nip position) with the developing sleeve 16, frictionally applies or attaches the yellow toner 20 onto the developing sleeve 16.

Along with the rotation of the developing sleeve 16, the yellow toner 20 attached to the developing sleeve 16 is caused to pass between the elastic blade 19 and the developing sleeve 16 at their abutting position, where the toner is rubbed with the surfaces of both the developing sleeve 16 and the elastic blade 19 to be provided with a sufficient triboelectric charge.

The thus triboelectrically charged yellow toner 20 having passed through the abutting position between the developing sleeve 16 and the elastic blade 19 forms a thin layer of yellow toner to be conveyed to a developing position facing the photosensitive member 1. At the developing position, the developing sleeve 16 is supplied with a DC-superposed AC bias voltage by a bias application means 17, whereby the yellow toner 20 on the developing sleeve is transferred and attached onto the electrostatic image on the photosensitive member 1, to form a toner image.

A portion of the yellow toner 20 remaining on the developing sleeve 16 without being transferred onto the photosensitive member 1 at the developing position is recovered into the outer wall 22 while passing below the developing sleeve 16 along with the rotation of the developing sleeve 16.

The recovered yellow toner 20 is peeled apart from the developing sleeve 16 by the toner application roller 18 at the abutting position with the developing sleeve 16. Simultaneously therewith, a fresh yellow toner 20 is supplied to the developing sleeve 16 by the rotation of the toner application roller 18, and the fresh yellow toner 20 is again moved to the abutting position between the developing sleeve and the elastic blade 19.

On the other hand, most of the yellow toner 20 peeled apart from the developing sleeve 16 is mixed with the remaining toner 22 in the outer wall, whereby the triboelectric charge of the peeled-apart toner is dispersed therein. A portion of the toner at a position remote from the toner application roller 18 is gradually supplied to the toner application roller 18 by a stirring means 21.

A non-magnetic color toner prepared in a manner as described above can exhibit good developing performance and continuous image forming characteristic in the above-described non-magnetic mono-component developing step.

The developing sleeve 16 may preferably comprise an electroconductive cylinder of a metal or alloy, such as aluminum or stainless steel, but can be composed of an electroconductive cylinder formed of a resin composition having sufficient mechanical strength and electroconductivity. The developing sleeve 16 may comprise a cylinder of a metal or alloy surface-coated with a coating layer of a resin composition containing electroconductive fine particles dispersed therein.

The electroconductive particles may preferably exhibit a volume resistivity of at most 0.5 ohm·cm after compression at 120 kg/cm$^2$. The electroconductive fine particles may preferably comprise carbon fine particles, a mixture of carbon fine particles and crystalline graphite powder, or crystalline graphite powder. The electroconductive fine particles may preferably have a particle size of 0.005–10 $\mu$m.

Example of the resin material constituting the resin composition may include: thermoplastic resins, such as styrene resin, vinyl resin, polyethersulfone resin, polycarbonate resin, polyphenylene oxide resin, polyamide resin, fluorine-containing resin, cellulosic resin, and acrylic resin; and thermosetting or photocurable resins, such as epoxy resin, polyester resin, alkyd resin, phenolic resin, melamine resin, polyurethane resin, urea resin, silicone resin, and polyimide resin.

Among the above, it is preferred to use a resin showing a releasability such as silicone resin or fluorine-containing resin; or a resin showing excellent mechanical properties, such as polyethersulfone, polycarbonate, polyphenylene oxide, polyamide, phenolic resin, polyester, polyurethane or styrene resin. Phenolic resin is particularly preferred.

The electroconductive fine particles may preferably be used in 3–20 wt. parts per 100 wt. parts of the resin component.

In the case of using a mixture of carbon fine particles and graphite particles, it is preferred to use 1–50 wt. parts of carbon fine particles per 100 wt. parts of graphite particles.

The electroconductive particle-dispersed resin coating layer of the sleeve may preferably show a volume resistivity of $10^{-6}$–$10^{6}$ ohm·cm.

The image forming apparatus shown in FIG. 4 further includes a magenta developing device 4-2 and a cyan developing device 4-3 each of which may be a non-magnetic mono-component developing device having a structure similar to that of the yellow developing device 4-1 described above with reference to FIG. 6, and after these non-magnetic mono-component developing devices 4-1, 4-2 and 4-3, a magnetic black developing device described with reference to FIG. 5 is placed for black development according to the magnetic mono-component development mode.

FIG. 7 illustrates another multi-color or full-color image forming apparatus, wherein a transfer belt 15 is used as a secondary transfer means.

Referring to FIG. 7, the transfer belt 17 is supported about a shaft parallel to a rotation axis of the intermediate transfer member so as to be in contact with a lower surface of the intermediate transfer member 5. The transfer belt 15 is supported about a bias roller 14 and a tension roller 17. The bias roller 14 is supplied with a desired secondary transfer bias voltage from a secondary transfer voltage supply 23, and the tension roller 12 is grounded.

Incidentally, a primary transfer bias voltage for superpositive transfer of first to fourth color toner images from the photosensitive member 1 to the intermediate transfer member 5 is of a polarity (+in this embodiment) opposite to that of the toner and is supplied from a bias supply 6 to the intermediate transfer member 5.

For transfer of the superposedly transferred color toner images on the intermediate transfer member 5 to a transfer-receiving material P, the transfer belt 10 is abutted against the intermediate transfer member 5, a transfer-receiving material P is supplied from a paper supply cassette (not shown) via a register roller 13 and a transfer pre-guide 24 to a nip between the intermediate transfer member and the transfer belt 15 at a prescribed time, and simultaneously a secondary transfer bias voltage is supplied to the bias roller 14 from the bias supply 23. Under the action of the transfer bias voltage, the color toner image may be transferred from the intermediate transfer member 5 to the transfer-receiving material P. This step may be called secondary transfer.

FIG. 8 illustrates still another multi-color or full-color image forming apparatus, wherein a transfer belt 13 equipped with a bias-application means 13*a* is used as an intermediate transfer means.

In the multi-color or full-color image forming method according to the present invention, the respective toners and the process conditions may preferably be set to provide a fixed solid image of the magnetic black toner and the fixed solid images of the respective non-magnetic color toners both showing a gloss value in the range of 5–30, more preferably 10–25, and providing a gloss value difference therebetween of at most 5, so as to provide a good quality of full-color images.

The image bearing member (photosensitive member) 1 used in the present invention may preferably have a surface exhibiting a contact angle with water of at least 8 deg., more preferably at least 90 deg. If the contact angle with water is 85 deg. or larger, the toner image transferability may be increased and the toner filming is less liable to occur.

The image forming method according to the present invention is particularly effective in case where the surface of the image bearing member 1 principally comprises a polymeric material or binder. This may include the case where an inorganic photosensitive layer of, e.g., selenium or amorphous silicon is coated with a protective film principally comprising a resin; the case of using a function separation-type organic photoconductor layer including a surface layer comprising a charge transport substance and a resin; and the use of using such an organic photoconductor layer further coated with a resinous protective film as described above. Such a surface layer may be provided with a releasability so as to provide an increased contact angle with water, e.g., by (1) using a resin having a low surface energy for constituting the layer, (2) incorporating an additive imparting water-repellency or lipophillicity and (3) dispersing a powder of a material exhibiting high releasability. The measure (1) may be effected by introducing a fluorine-containing group or a silicon-containing group into the resin. The measure (2) may be effected by adding a surfactant, etc. The measure (3) may be effected by using powder of fluorine-containing compound, such as polytetrafluoroethylene, polyvinylidene fluoride, or fluorinated carbon. Among these, polytetrafluoroethylene is most suited. In the present invention, it is particularly suited to disperse a powder of a releasable material, such as a fluorine-containing resin according to the measure (3).

The incorporation of such a powder at the surface may be performed by forming anew a surface layer comprising such a powder dispersed within a binder resin onto the surface most layer of an organic photoconductive layer comprising principally a resin without forming anew such a surface layer.

The powder may be added in 1–60 wt. %, preferably 2–50 wt. %, of the total weight of the surface layer. Below 1 wt. %, the improvement effect is scarce and, above 60 wt. %, the resultant film is caused to have a lower strength or reduce the quantity of light incident to the image bearing member.

The above technique is particularly effective in the case of using a contact charging method wherein a charging member is directly abutted against the image bearing member in comparison with a corona charging method wherein the charging means does not directly contact the image bearing member. This is because the improvement in life can be remarkable in the former case wherein a larger load is applied to the image bearing member surface.

Figure 11:
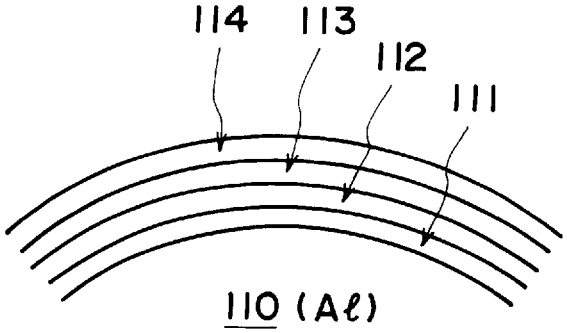
FIG. 11 is a schematic partial sectional illustration of a photosensitive drum as an image bearing member.
Figure 12:
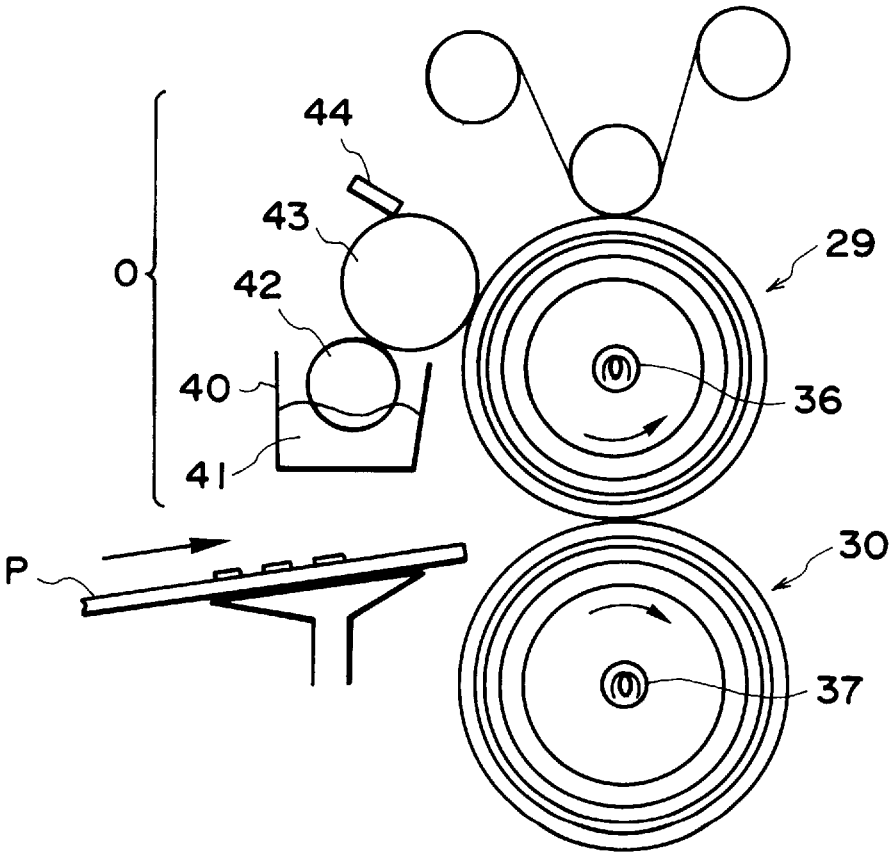
FIG. 12 is a schematic illustration of a heat-pressure fixing device equipped with an oil applicator used in a conventional multi-color or full-color image forming apparatus.

FIG. 11 is a preferred embodiment of such an image bearing member, i.e., one having a laminate structure successively including an (electroconductive) substrate 110, an optional electroconductive coating layer 111, an undercoating layer 112, a charge generation layer 113 and a charge transport layer 114. The organization of the respective layers will be described below in further detail.

The electroconductive support 110 (or a combination of 110 and 111) may comprise a metal, such as aluminum or stainless steel, a plastic coated with a layer of aluminum alloy or indium oxide-tin oxide alloy, paper or a plastic sheet impregnated with electroconductive particles, or a plastic comprising an electroconductive polymer in a shape of a cylinder or a sheet.

On the electroconductive support, it is possible to dispose an undercoating layer 112 for the purpose of providing an improved adhesion and applicability of the photosensitive layer, protection of the support, coverage of defects on the support, an improved charge injection from the support, and protection of the photosensitive layer from electrical breakage. The undercoating layer may comprise polyvinyl alcohol, poly-N-vinylimidazole, polyethylene oxide, ethyl cellulose, methyl cellulose, nitrocellulose, ethylene-acrylic acid copolymer, polyvinyl butyral, phenolic resin, casein, polyamide, copolymer nylon, glue, gelatin, polyurethane, or aluminum oxide. The thickness may ordinarily be 0.1–3 $\mu$m.

The charge generation layer 113 may comprise a charge generation substance, examples of which may include: organic substances, such as azo pigments, phthalocyanine pigments, indigo pigments, perylene pigments, polycyclic quinone pigments, pyrylium salts, thiopyrilium salts, and triphenylmethane dyes; and inorganic substances, such as selenium and amorphous silicon, in the form of a dispersion in a film of an appropriate binder resin or a vapor deposition film thereof. The binder resin may be selected from a wide variety of resins, examples of which may include polycarbonate resin, polyester resin, polyvinyl butyral resin, polystyrene resin, acrylic resin, methacrylic resin, phenolic resin, silicone resin, epoxy resin, and vinyl acetate resin. The binder resin may be contained in an amount of at most 80 wt. %, preferably 0–40 wt. %, of the charge generation layer. The charge generation layer may preferably have a thickness of at most 5 $\mu$m, preferably 0.05–2 $\mu$m.

A charge transport layer 114 has a function of receiving charge carriers from the charge generation layer and transporting the carriers under an electric field. The charge transport layer may be formed by dissolving a charge transporting substance optionally together with a binder resin in an appropriate solvent to form a coating liquid and applying the coating liquid. The thickness may ordinarily be 0.5–40 μm. Examples of the charge transporting substance may include: polycyclic aromatic compounds having in then main chain or side chain a structure such as biphenylene, anthracene, pyrene or phenanthrene; nitrogen-containing cyclic compounds, such as indole, carbazole, oxadiazole, and pyrazoline; hydrazones, styryl compounds, selenium, selenium-tellurium, amorphous silicon and cadmium sulfide.

Examples of the binder resin for dissolving or dispersing therein the charge transporting substance may include: resins, such as polycarbonate resin, polyester resin, polystyrene resin, acrylic resins, and polyamide resins; and organic photoconductive polymers, such as poly-N-vinylcarbazole and polyvinyl-anthracene.

As described above, it is possible to further dispose a surface protective layer. The protective layer may comprise a resin, such as polyester, polycarbonate, acrylic resin, epoxy resin, phenolic resin or a product obtained by curing these resins in the presence of a hardener. These resins may be used singly or in combination of two or more species.

It is possible to disperse electroconductive fine particles in the protective layer resin. The electroconductive particles may be fine particles of a metal or a metal oxide. Specific examples thereof may include: fine particles of materials, such as zinc oxide, titanium oxide, tin oxide, antimony oxide, indium oxide, bismuth oxide, tin oxide-coated titanium oxide, tin-coated indium oxide, antimony-coated tin oxide, and zirconium oxide. These may be used singly or in combination of two or more species. In case of dispersing electroconductive fine particles in the protective layer, it is generally preferred that the electroconductive particles have a particle size smaller than the wavelength of incident light in order to avoid the scattering of the incident light with the electroconductive fine particles. Accordingly, the electroconductive particles dispersed in the protective layer may preferably have an average particle size of at most 0.5 μm. The content thereof may preferably be 2–90 wt. %, more preferably 5–80 wt. % of the total weight of the protective layer. The protective layer may have a thickness of 0.1–10 μm, preferably 1–7 μm.

The surface layer may be formed by applying a resin dispersion liquid by spray coating, beam coating or dip coating.

Hereinbelow, the present invention will be described with reference to specific Examples.

PHOTOSENSITIVE MEMBER PRODUCTION EXAMPLE 1

Photosensitive member No. 1 having a laminar structure as shown in FIG. 11 was formed by coating a 30 mm-dia. aluminum (A1) cylinder successively with the following layers by dipping:

(1) a 15 μm-thick electroconductive coating layer principally comprising a phenolic resin containing powdery tin oxide and titanium oxide dispersed therein, (2) a 0.6 μm-thick undercoating layer principally comprising modified nylon and copolymer nylon, (3) a 0.6 μm-thick charge-generation layer containing an azo pigment having an absorption peak in a long-wavelength region dispersed in a butyral resin.

(4) a 25 μm-thick charge transport layer principally comprising an 8:10 (by weight) solution mixture of a hole-transporting triphenylamine compound and a polycarbonate resin (having a molecular weight of $2\times10^4$ according to the Ostwald viscosity method) and further containing 0.2 μm-dia. polytetrafluoroethylene powder in 10 wt. % of the total solid uniformly dispersed therein. The layer exhibited a contact angle with pure water of 95 deg. as measured by using a contact angle water ("Model CA-X", available from Kyowa Kaimen Kagaku K.K.).

PHOTOSENSITIVE MEMBER PRODUCTION EXAMPLE 2

Photosensitive member No. 2 was prepared in the same manner as in photosensitive member Production Example 2 except for omitting the polytetrafluoroethylene powder from the charge transport layer. It provided a contact angle with water of 74 deg.

PHOTOSENSITIVE MEMBER PRODUCTION EXAMPLE 3

Photosensitive member 3 was prepared as follows. A lower structure up to the charge generation layer was prepared in the same manner as in photosensitive member Production Example 1. The charge generation layer was coated with a 20 μm-thick charge transport layer comprising a 10:10 (by weight)-solution mixture of the hole-transporting triphenylamine compound and the polycarbonate resin, and further with a 5 μm-thick spray-coated protective layer comprising a 5:10 (by weight) solution mixture of the same triphenyl amine compound and polycarbonate resin and further containing 0.2 μm-dia. polytetrafluoroethylene powder in 30 wt. % of the total solid. It exhibited a contact angle with water of 102 deg.

BINDER RESIN PRODUCTION EXAMPLE 1

A monomer mixture comprising 70 wt. parts of styrene, 23.5 wt. parts of n-butyl acrylate, 6 wt. parts of mono-n-butyl maleate, 0.3 wt. part of divinylbenzene and 1.1 wt. parts of di-tert-butyl peroxide was added dropwise in 3 hours into a vessel equipped with a condenser and containing xylene under reflux and further subjected to 8 hours of solution polymerization under xylene reflux, followed by distilling-off of xylene under a reduced pressure to obtain Binder resin No. 1, of which the properties are summarized in Table 1 together with binder resins formed in the following Examples.

BINDER RESIN PRODUCTION EXAMPLES 2–5

Binder resins Nos. 2–5 shown in Table 1 were prepared similarly as in Production Example 1 while changing monomer weight ratios, amount of divinylbenzene and amount of polymerization initiator, etc.

BINDER RESIN PRODUCTION EXAMPLE 6

(Synthesis of Low-molecular weight polymer (L-1))

Into a four-necked flask, 300 wt. parts of xylene was placed and, after sufficient replacement with nitrogen in the flask under stirring, the xylene was heated and refluxed.

Under the xylene reflux, a mixture liquid of 82 wt. parts of styrene, 18 wt. parts of n-butyl acrylate and 2 wt. parts of di-tert-butyl peroxide was added dropwise in 4 hours and further held for 2 hours to complete the polymerization, thereby obtaining a solution of Low-molecular weight polymer (L-1).

(Synthesis of High-molecular weight polymer (H-1))

Into a four-necked flask, 180 wt. parts of de-gassed water and 20 wt. parts of 2 wt. %-polyvinyl alcohol aqueous solution were placed and, under stirring, a mixture liquid of 75 wt. parts of styrene, 25 wt. parts of n-butyl acrylate and 0.1 wt. part of 2,2-bis(4,4-di-tert-butylperoxycyclohexyl) propane (having a 10 hour-half-life temperature of 92° C.) was added to form a suspension liquid.

Under sufficient aeration with nitrogen in the flask, the temperature in the flask was raised to 85° C. to initiate the polymerization. After polymerization for 24 hours at that temperature, 0.1 wt. part of benzoyl peroxide (10 hour-half-life temperature=72° C.) was further added to effect further 12 hours of polymerization, to complete the polymerization. The polymerizate was recovered by filtration from the suspension liquid, washed with water and dried to obtain High-molecular weight polymer (H-1).

To 225 wt. parts of the solution of Low-molecular weight polymer (L-1), 25 wt. parts of High-molecular weight polymer (H-1) was added and mixed under reflux, followed by removal of xylene to obtain Binder resin No. 6.

BINDER RESIN PRODUCTION EXAMPLE 7

Low-molecular weight polymer (L-2) was prepared by using 84.5 wt. parts of styrene, 15.5 wt. parts of n-butyl acrylate and 6 wt. parts of di-tert-butyl peroxide in a similar manner as in Production Example 1.

Then, 25 wt. parts of Low-molecular weight polymer (L-2), 58 wt. parts of styrene, 17 wt. parts of n-butyl acrylate, 0.5 wt. part of divinylbenzene and 1.7 wt. part of di-tert-butylperoxide were mixed to prepare a monomer solution, which was then added into 200 wt. parts of water containing 0.15 wt. part of polyvinyl alcohol (partially saponified) to effect 12 hours of suspension polymerization. The polymerizate was recovered from the suspension liquid after the polymerization, washed with water and dried to obtain Binder resin No. 7.

BINDER RESIN PRODUCTION EXAMPLE 8

Binder resin No. 8 was prepared similarly as in Production Example 1 while changing the monomer weight ratio, amount of divinylbenzene and amount of polymerization initiator, etc.

TABLE 1

| Binder resin | DVB*1 (wt. %) | THF*2-ins. (wt. %) | GPC molecular weight characteristics of THF-soluble content: Mw | Mn | Mw/Mn | ≦5.0 × 10⁴ content (%) | 5.0 × 10⁴–5.0 × 10⁵ content (%) | ≧5.0 × 10⁵ content (%) | Main peak ×10⁴ | Sub-peak ×10⁴ | Acid value (mgKOH/g) | Tg (°C.) |
|---|---|---|---|---|---|---|---|---|---|---|---|---|
| No. 1 | 0.30 | 0 | 150,000 | 14,000 | 10.7 | 55 | 35 | 10 | 3.3 | none | 17.0 | 60 |
| No. 2 | 0.28 | 0 | 140,000 | 13,000 | 10.8 | 60 | 30 | 10 | 4.1 | none | 10.0 | 62 |
| No. 3 | 0.40 | 0 | 350,000 | 20,000 | 17.5 | 50 | 42 | 8 | 4.3 | none | 5.0 | 59 |
| No. 4 | 0.50 | 3 | 420,000 | 25,000 | 16.8 | 51 | 26 | 23 | 5.0 | none | 1.5 | 61 |
| No. 5 | 1.00 | 7 | 670,000 | 42,000 | 16.0 | 42 | 29 | 28 | 7.5 | none | 1.5 | 60 |
| No. 6 | 0 | 0 | 350,000 | 6,600 | 53.0 | 62 | 16 | 22 | 1.0 | 50 | 0 | 60 |
| No. 7 | 0.50 | 20 | 870,000 | 62,000 | 14.0 | 26 | 52 | 22 | 15 | none | 0 | 62 |
| No. 8 | 0 | 0 | 12,000 | 5,700 | 2.1 | 77 | 23 | 0 | 0.8 | none | 0 | 58 |

*1Arround of DVB (divinylbenzene) added.
*2THF (tetrahydrofuran)-insoluble content.

EXAMPLE 1

100 wt. parts of Binder resin No. 1, 100 wt. parts of magnetic material (Dav. (number-average particle size)= 0.22 μm), 2 wt. parts of negative charge control agent (monoazo dye iron complex), and 4 wt. parts of Solid wax No. 1 shown in Table 2) were blended in a blender, and the blend was melt-kneaded through an extruder heated at 110° C. The melt-product kneaded was cooled, coarsely crushed by a hammer mill and then finely pulverized by a mechanical pulverizer ("Turbomill", available from Turbo Kogyo K.K.). The pulverizate was subjected to classification by means of a multi-division classifier utilizing the Coanda effect ("Elbow Jet Classifier", available from Nittetsu Kogyo K.K.) to obtain Magnetic black toner particles No. 1, the properties of which are shown in Tables 3 and 4 together with those of other Magnetic black toner particles. A GPC chromatogram of the THF-soluble content of the binder resin recovered from the Magnetic black toner particles No. 1 is shown in FIG. 1.

100 wt. parts of Magnetic black toner particles No. 1 were blended with 1.4 wt. parts of hydrophobic dry-process silica fine powder ($S_{BET}$ (BET specific surface area)=170 $m^2/g$, $D_{NP}$ (number-average primary particle size)=12 nm) (as first inorganic fine powder) and 0.2 wt. part of spherical silica fine powder ($S_{BET}$=20 $m^2/g$, $D_{NP}$=100 nm, sphericity ψ=0.98) (as second inorganic fine powder) to prepare Magnetic black toner No. 1.

The properties of Magnetic black toner No. 1 are shown in Table 4 together with those of other magnetic black toners. Magnetic black toner No. 1 also showed SF-1=141 and SF-2=127, identical to those obtained for Magnetic black toner particles No.1 before the addition of the inorganic fine powders and shown in Table 4.

Figure 2:
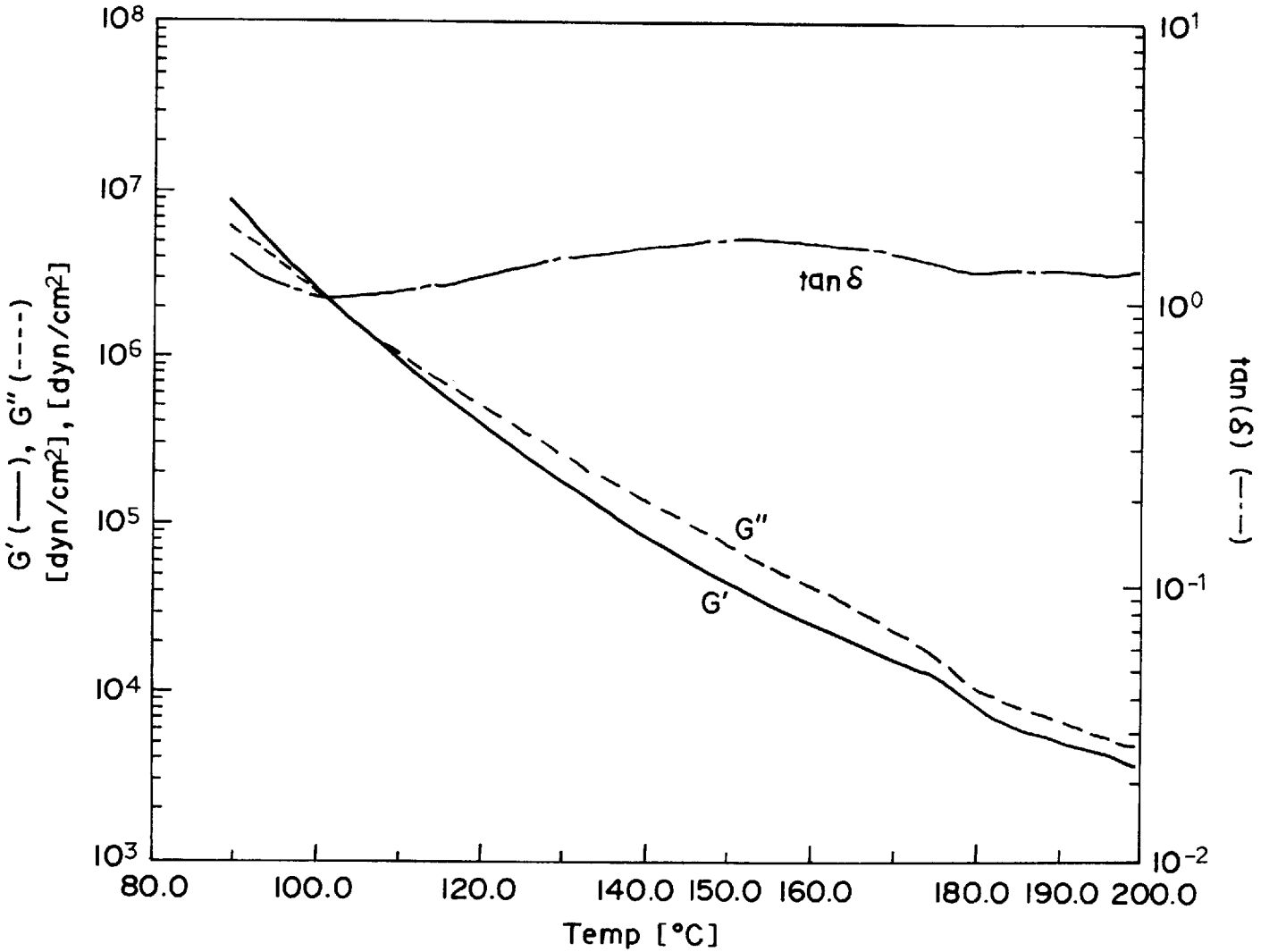
FIG. 2 is a graph showing viscoelasticity characteristics of a magnetic black toner according to the invention.

The viscoelasticity characteristic curves of Magnetic black toner No. 1 are shown in FIG. 2.

The anti-blocking property shown in Table 4 was evaluated in the following manner.

Anti-blocking property test

Ca. 10 g of a toner sample is placed in a plastic cup and stored for three days at 50° C. The blocking state of the toner sample is evaluated by observation with eyes according to the following standards:

A: No agglomerate is found.

B: Some agglomerate is found but is easily collapsible.

C: Agglomerate is found but collapsed by shaking.

D: Agglomerate can be grasped and cannot be collapsed easily.

TABLE 2

| Solid wax | Type | DSC heat-absorption main-peak temp. (°C.) | Mw | Mn | Mw/Mn |
|---|---|---|---|---|---|
| No. 1 | Low-molecular weight polyethylene wax | 107 | 880 | 800 | 1.1 |
| No. 2 | Purified paraffin wax | 75 | 500 | 420 | 1.2 |
| No. 3 | Purified sasol wax | 98 | 4350 | 800 | 1.7 |
| No. 4 | Purified ester wax | 78 | 1100 | 570 | 1.9 |
| No. 5 | Long-chain alkyl alcohol wax | 105 | 830 | 470 | 1.9 |
| No. 6 | Low-molecular weight polypropylene wax | 143 | 19000 | 4000 | 4.8 |
| No. 7 | Low-molecular weight polyethylene wax | 128 | 7700 | 2200 | 3.5 |
| No. 8 | Paraffin wax | 55 | 370 | 285 | 1.3 |

COMPARATIVE EXAMPLES 1–4

Comparative Magnetic black toner particles Nos. 1–4 were prepared in the same manner as in Example 1 except for using Binder resins Nos. 5–8, respectively, in place of Binder resin No. 1. Comparative Magnetic black toners Nos. 1–4 were prepared similarly as in Example 1 from Comparative Magnetic black toner particles Nos. 1–4, respectively. The properties of Comparative Magnetic black toner particles Nos. 1–4 and Comparative Magnetic black toners Nos. 1–4 are shown in Tables 3 and 4.

Figure 3:
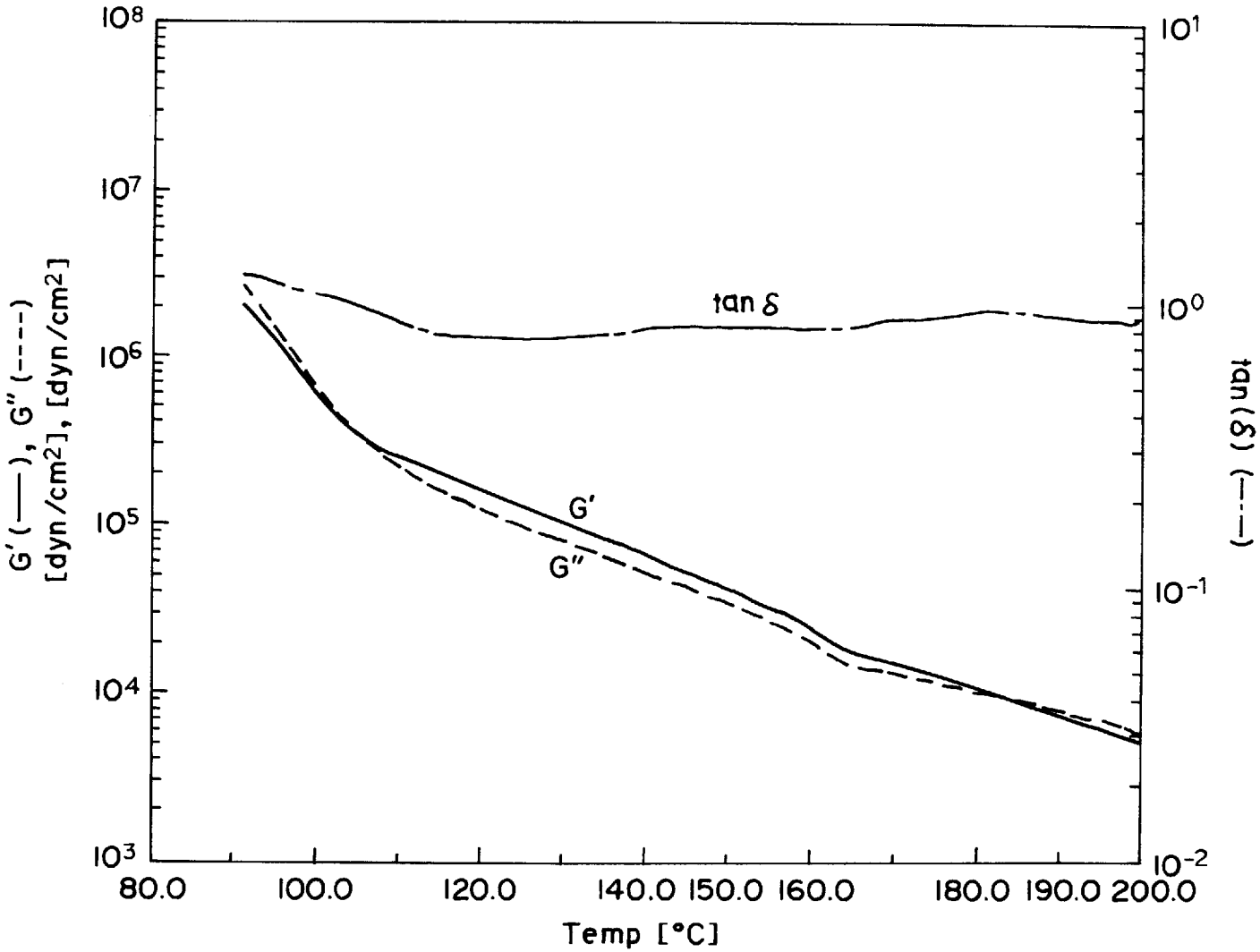
FIG. 3 is a graph showing viscoelasticity characteristics of a comparative magnetic black toner.

The viscoelasticity characteristic curves of Comparative Magnetic black toner No. 2 are shown in FIG. 3.

COMPARATIVE EXAMPLES 5–7

Comparative Magnetic black toner particles Nos. 5–7 were prepared in the same manner as in Example 1 except for using Solid waxes Nos. 6–8, respectively, in place of Binder wax No. 1. Comparative Magnetic black toners Nos. 5–7 were prepared similarly as in Example 1 from Comparative Magnetic black toner particles Nos. 5–7, respectively. The properties of Comparative Magnetic black toner particles Nos. 5–7 and Comparative Magnetic black toners Nos. 5–7 are shown in Tables 3 and 4.

EXAMPLES 2–4

Magnetic black toner particles Nos. 2–4 were prepared in the same manner as in Example 1 except for using Binder resins Nos. 2–4, respectively, in place of Binder resin No. 1. Magnetic black toners Nos. 2–4 were prepared similarly as in Example 1 from Magnetic black toner particles Nos. 2–4, respectively. The properties of Magnetic black toner particles Nos. 2–4 and Magnetic black toners Nos. 2–4 are shown in Tables 3 and 4.

EXAMPLES 5–8

Magnetic black toner particles Nos. 5–8 were prepared in the same manner as in Example 1 except for using Solid waxes Nos. 2–5, respectively, in place of Solid wax No. 1. Magnetic black toners Nos. 5–8 were prepared similarly as in Example 1 from Magnetic black toner particles Nos. 5–8, respectively. The properties of Magnetic black toner particles Nos. 5–8 and Magnetic black toners Nos. 5–8 are shown in Tables 3 and 4.

EXAMPLE 9

100 wt. parts of Magnetic black toner particles No. 1 were blended with 1.6 wt. parts of dry-process silica treated with dimethyldichlorosilane ("R972", available from Nippon Aerosil K.K.) to prepare Magnetic black toner No. 9.

EXAMPLE 10

100 wt. parts of Magnetic black toner particles No. 1 were blended with 1.6 wt. parts of hydrophobic dry process silica treated with hexamethyldisilazane an then with dimethylsilicone ($D_{NP}$=12 nm) to prepare Magnetic black toner No. 10.

TABLE 3

| | | | | Properties of binder resin constituting magnetic toner particles | | | | | | |
|---|---|---|---|---|---|---|---|---|---|---|
| | | | | | Molecular weight characteristics of THF-soluble content | | | | | |
| Ex. or Comp. Ex. | Magnetic black toner | Binder resin No. | Solid wax No. | THF-ins. (wt. %) | Mw | Mn | Mw/Mn | $\leqq 5.0 \times 10^4$ content (%) | $5.0 \times 10^4$–$5.0 \times 10^5$ content (%) | $\geqq 5.0 \times 10^5$ content (%) |
| Ex. 1 | No. 1 | 1 | 1 | 0 | 147,000 | 13,800 | 10.6 | 56 | 34 | 10 |
| Comp. Ex. | Comp. No. | | | | | | | | | |
| 1 | 1 | 5 | 1 | 6 | 590,000 | 37,000 | 15.9 | 43 | 30 | 27 |
| 2 | 2 | 6 | 1 | 0 | 348,000 | 6,450 | 54.0 | 63 | 17 | 20 |
| 3 | 3 | 7 | 1 | 9 | 750,000 | 58,500 | 12.8 | 27 | 53 | 20 |
| 4 | 4 | 8 | 1 | 0 | 11,000 | 5,600 | 2.0 | 78 | 22 | 0 |
| 5 | 5 | 1 | 6 | 0 | 147,000 | 13,800 | 10.6 | 56 | 34 | 10 |
| 6 | 6 | 1 | 7 | 0 | 147,000 | 13,800 | 10.6 | 56 | 34 | 10 |
| 7 | 7 | 1 | 8 | 0 | 147,000 | 13,800 | 10.6 | 56 | 34 | |

TABLE 3-continued

| Ex. or Comp. Ex. | Magnetic black toner | Binder resin No. | Solid wax No. | THF-ins. (wt. %) | Properties of binder resin constituting magnetic toner particles: Molecular weight characteristics of THF-soluble content: Mw | Mn | Mw/Mn | ≦5.0 × $10^4$ content (%) | 5.0 × $10^4$–5.0 × $10^5$ content (%) | ≧5.0 × $10^5$ content (%) |
|---|---|---|---|---|---|---|---|---|---|---|
| Ex. | No. | | | | | | | | | |
| 2 | 2 | 2 | 1 | 0 | 138,000 | 12,600 | 10.9 | 62 | 29 | 9 |
| 3 | 3 | 3 | 1 | 0 | 335,000 | 19,700 | 17.0 | 51 | 41 | 8 |
| 4 | 4 | 4 | 1 | 2 | 395,000 | 22,700 | 17.4 | 52 | 27 | 21 |
| 5 | 5 | 1 | 2 | 0 | 147,000 | 13,800 | 10.6 | 56 | 34 | 10 |
| 6 | 6 | 1 | 3 | 0 | 147,000 | 13,800 | 10.6 | 56 | 34 | 10 |
| 7 | 7 | 1 | 4 | 0 | 147,000 | 13,800 | 10.6 | 56 | 34 | 10 |
| 8 | 8 | 1 | 5 | 0 | 147,000 | 13,800 | 10.6 | 56 | 34 | 10 |

TABLE 4

| Ex. or Comp. Ex. | Magnetic black toner | Viscoelasticities of magnetic toner: tan δ at 100° C. C | tan δ at 150° C. D | D/C | tan δ in 150–190° C. E: Emin. | Emax. | Shape factors of magnetic toner particles: SF-1 | SF-2 | B/A | Magnetic toner $D_4$ (μm) | Anti-blocking at 50° C. |
|---|---|---|---|---|---|---|---|---|---|---|---|
| Ex. 1 | No.1 | 1.00 | 1.63 | 1.63 | 1.31 | 1.69 | 141 | 127 | 0.64 | 6.9 | A |
| Comp. Ex. | Comp. No. | | | | | | | | | | |
| 1 | 1 | 1.00 | 0.72 | 0.72 | 0.70 | 0.85 | 165 | 139 | 0.64 | 7.5 | A |
| 2 | 2 | 1.00 | 0.85 | 0.85 | 0.80 | 0.95 | 155 | 135 | 0.64 | 8.0 | A |
| 3 | 3 | 0.89 | 0.69 | 0.77 | 0.65 | 0.92 | 157 | 139 | 0.60 | 10.5 | A |
| 4 | 4 | 7.50 | 4.50 | 0.22 | 7.50 | 2.20 | 162 | 143 | 0.69 | 6.3 | C |
| 5 | 5 | 1.00 | 1.62 | 1.62 | 1.30 | 1.67 | 142 | 127 | 0.64 | 7.1 | A |
| 6 | 6 | 1.00 | 1.62 | 1.62 | 1.30 | 1.68 | 165 | 143 | 0.69 | 6.9 | A |
| 7 | 7 | 1.10 | 1.70 | 1.54 | 1.31 | 1.72 | 147 | 133 | 0.65 | 7.0 | D |
| Ex. | No. | | | | | | | | | | |
| 2 | 2 | 1.00 | 1.44 | 1.44 | 1.29 | 1.51 | 142 | 127 | 0.65 | 7.5 | A |
| 3 | 3 | 1.00 | 1.69 | 1.69 | 1.37 | 1.83 | 141 | 127 | 0.64 | 7.0 | A |
| 4 | 4 | 1.00 | 1.19 | 1.19 | 1.08 | 1.43 | 142 | 126 | 0.64 | 7.1 | A |
| 5 | 5 | 1.01 | 1.65 | 1.63 | 1.33 | 1.70 | 143 | 127 | 0.63 | 6.9 | B |
| 6 | 6 | 1.00 | 1.65 | 1.64 | 1.31 | 1.69 | 141 | 127 | 0.62 | 6.9 | A |
| 7 | 7 | 1.01 | 1.65 | 1.63 | 1.32 | 1.70 | 142 | 126 | 0.63 | 7.1 | B |
| 8 | 8 | 1.01 | 1.66 | 1.64 | 1.31 | 1.70 | 144 | 128 | 0.63 | 6.9 | A |

Non-magnetic toner production examples are described below.

PRODUCTION EXAMPLE 1

| | |
|---|---|
| Styrene monomer | 165 wt. part(s) |
| n-Butyl acrylate monomer | 35 wt. part(s) |
| Phthalocyanine pigment (C.I. Pigment Blue 15:3) | 14 wt. part(s) |
| Linear polyester resin (polycondensate between polyoxypropylene-added bisphenol A and phthalic acid, acid value = 8) | 10 wt. part(s) |
| Dialkylsalicylic acid aluminum compound | 2 wt. part(s) |
| Ester wax (ester between $C_{22}$-alkylcarboxylic acid and $C_{22}$-alkyl alcohol, DSC heat-absorption main-peak temp. = 75° C., half-value width = 3° C.) | 30 wt. part(s) |

The above ingredients were dispersed for 3 hours in an attritor, and 3 wt. parts of lauroyl peroxide as a polymerization initiator was added thereto to form a polymerizable mixture, which was charged into aqueous medium at 70° C. comprising 1200 wt. parts of water and 7 wt. parts of tricalcium phosphate, followed by stirring at 10,000 rpm by a TK homomixer for 10 min. for particulation. Thereafter, the stirrer was changed to a propeller stirring blade and, under stirring at 60 rpm, the polymerization was performed for 10 hours. After completion of the polymerization, dilute hydrochloric acid was added to the system to remove calcium phosphate. Then, the polymerizate was washed and dried to obtain non-magnetic cyan toner particles having a weight-average particle size of 6.5 μm. The thus-obtained cyan toner particles found to have a section as shown in FIG. 10, wherein the low-softening point substance was enclosed with an outer shell resin as a result of microscopic observation.

100 wt. parts of the cyan toner particles and 1.5 wt. parts of hydrophobic silica fine powder were blended by a Henschel mixer to obtain a non-magnetic cyan toner.

The cyan toner had SF-1=105, contained ca. 15 wt. parts of ester wax per 100 wt. parts of the binder resin comprising styrene-n-butyl acrylate copolymer crosslinked with divinylbenzene and linear polyester resin (i.e., an ester wax content in toner of ca. 12 wt. %) and contained ca. 10 wt. % (based on the binder resin) of THF-insoluble content. The properties of the cyan toner are shown in Table 5 together with those of yellow and magenta toners prepared in the following Production Examples.

PRODUCTION EXAMPLE 2

A non-magnetic yellow toner was prepared in the same manner as in Production Example 1 except for using a yellow colorant (C.I. Pigment Yellow 173) in place of the cyan colorant.

PRODUCTION EXAMPLE 3

A non-magnetic magenta toner wag prepared in the same manner as in Production Example 1 except for using a magenta colorant (C.I. Pigment Red 122) in plate of the cyan colorant.

| | |
|---|---|
| Phenolic resin | 100 wt. parts |
| Graphite (Dav. = ca. 7 μm) | 90 wt. parts |
| Carbon black | 10 wt. parts |

Then, the gap between the image bearing member 1 and the developing sleeve 102 of the developing apparatus 4-4 was set at 300 μm, and the silicon rubber blade 105 having a thickness of 1.0 mm and a free length of 10 mm (as a toner thickness regulating member) was abutted at a linear pressure of 17.4 N/m (158/cm) against the developing sleeve 102 enclosing therein a fixed magnet 104 including a developing pole of 80 mT (800 gauss). The developing sleeve 102 was further supplied with a developing bias obtained by superposing a DC bias component Vdc=−450 volts and an AC bias component of Vpp=1200 volts and f=2000 Hz.

A 2.0 mm-thick urethane rubber blade 8 having a free length of 8 mm (as a cleaning blade) was abutted at a linear pressure of 24.5 N/m (25 g/cm) against the OPC photosensitive drum 1. The development was performed by a process speed V of 94 mm and a developing sleeve peripheral speed Vt giving a ratio Vt/V of 1.5. Magnetic black toner No. 1 was used as a Magnetic black toner.

TABLE 5

Properties of non-magnetic color toners

| | elasticity characteristics | | | | | | | | |
|---|---|---|---|---|---|---|---|---|---|
| | $G'_{50}$ (dyn cm$^2$) | $G'_{80}$ (dyn cm$^2$) | $G'_{50}G'_{80}$ | $G'_{155}$ (dyn cm$^2$) | G'190 (dyn/cm$^2$) | $G'_{155}/G'_{190}$ | $G''_{40}$ (dyn cm$^2$) | $G''_{max}$/temp. | $\tan\delta_{max}$/temp. |
| Cyan toner | $7 \times 10^8$ | $3 \times 10^6$ | 233 | $1 \times 10^4$ | $3 \times 10^3$ | 3.3 | $1 \times 10^9$ | $2 \times 10^8$/50° C. | 3/70° C. |
| Yellow toner | $7 \times 10^8$ | $4 \times 10^6$ | 175 | $1 \times 10^4$ | $4 \times 10^3$ | 2.5 | $1 \times 10^9$ | $2 \times 10^9$/51° C. | 3/68° C. |
| Magenta toner | $7 \times 10^8$ | $3 \times 10^6$ | 233 | $1 \times 10^4$ | $3 \times 10^3$ | 3.3 | $1 \times 10^9$ | $2 \times 10^9$/50° C. | 3/68° C. |

| | | | THF-ins. | GPC peak or shoulder molecular weight of binder resin ($\times 10^4$) | | |
|---|---|---|---|---|---|---|
| | $D_4$ (μm) | SF-1 | (wt. %) | main-peak | sub-peak or shoulder | Anti-block |
| Cyan toner | 6.5 | 105 | 9.6 | 2.2 | 15(S)*1, 110(S) | A |
| Yellow toner | 6.3 | 106 | 10.3 | 2.1 | 13(S), 115(S) | A |
| Magenta toner | 6.0 | 103 | 7.6 | 2.3 | 16(S), 100(S) | A |

*1(S) denotes a shoulder.

EXAMPLE 11

The image forming performances of the above-prepared Magnetic black toner No. 1 and the non-magnetic color toners were evaluated in the following manner.

An image forming apparatus having a structure as shown in FIG. 4 was used. A primary charging roller 2 having an outer diameter of 12 mm comprised a nylon resin-coated rubber roller electroconductive carbon dispersed therein and abutted at a pressure of 50 g/cm against an image bearing member 1 which was an OPC drum-type Photosensitive member Production Example 3. The image bearing member 1 was subjected to formation of a digital latent image by laser light exposure at 600 dpi so as to provide a dark part potential of −600 volts and a light part potential of −100 volts.

For black image development, a developing apparatus 4—4 having a structure as shown in FIG. 5 was used and disposed at the position of the developing device 4—4 in FIG. 4. More specifically, the developing sleeve 102 was prepared by coating a 16 mm-dia. surface-blasted aluminum cylinder with a ca. 7 μm-thick resin layer of the following composition so as to provide a center line-average roughness (Ra, according to JIS B0601-1982) of 2.2 μm.

On the other hand, the yellow toner, magenta toner and cyan toner were charged in the developing apparatus 4-1, 4-2 and 4-3, respectively, to effect reversal development of digital latent images formed under the above-mentioned conditions in an environment of 23° C. and 65% RH, thereby forming respective color toner images on the photosensitive member 1. Then, the thus-formed respective color toner images including a black toner image formed on the photosensitive member 1 were successively transferred onto the intermediate transfer member, and the resultant superposed toner image of 4 colors on the intermediate transfer member 5 was transferred onto a transfer-receiving material (plain paper) 6 having a basis weight of 75 m$^2$/g pressed by the transfer roller 7 against the intermediate transfer member while applying a bias voltage to the transfer roller 7 so as to pass a transfer current of +6 μA. The four-color toner image thus transferred on the transfer-receiving material 6 was subjected to heat-pressure fixation by an oil-less heat-pressure fixing device 25 to form a full-color image.

The heat-pressure fixation device 25 included an upper roller 11 comprising an aluminum cylinder having an outer diameter of 40 mm coated successively with a 3 mm-thick silicon rubber layer and a 50 μm-thick outermost fluorine-containing resin (PFA) layer, and a lower roller 10 comprising an aluminum cylinder having an outer diameter of 40 mm and successively coated with a 2 mm-thick silicone rubber layer and a 50 μm-thick outermost fluorine-containing resin (PFA) layer. The fixing device was operated under a total pressure of 45 kg/30 cm, a fixing nip width of 6.5 mm and a fixing speed of 120 mm/sec while setting the upper roller surface temperature at a prescribed temperature to evaluate the fixability and the gloss of fixed images.

During the operation, the transfer efficiency of the respective color toner images was 95–98% from the photosensitive member 1 to the intermediate transfer member 5, and 95–98% from the intermediate transfer member 5 to the transfer-receiving material 6, thus exhibiting a high overall transfer efficiency of 90–96%. The resultant toner images were good full-color images showing good color mixability and free from transfer dropout (hollow image) or free from toner scattering on the images.

No. 1 (showing a contact angle with water of 95 deg.) in place of Photosensitive member No. 3 (showing a contact angle with water of 102 deg.), whereby the continuous image formation performance was slightly inferior and residual toner amount on the photosensitive member was slightly larger than in Example 11.

EXAMPLE 22

An image forming test was performed in the same manner as in Example 11 except for using Photosensitive member No. 2 (showing a contact angle with water of 74 deg.) in place of Photosensitive member No. 3, whereby the continuous image formation performance was inferior and residual toner amount on the photosensitive member was larger compared with Examples 11 and 21.

TABLE 6

| Ex. or Comp. Ex. | Magnetic black toner or color toner | Gloss of fixed images 150° C. | 160° C. | 170° C. | 180° C. | 190° C. | Black toner performaces: Fixable temp. range (°C.) | Image quality | Continuous image formation | Winding about a heating roller | Full-color image quality |
|---|---|---|---|---|---|---|---|---|---|---|---|
| Ex. 1 | Black No. 1 | 5.3 | 7.2 | 10.5 | 13.5 | 17.0 | 145–220 | A | A | A | A |
| | Yellow | 8.5 | 9.5 | 10.5 | 12.0 | 14.0 | | | | | |
| | Magenta | 8.5 | 9.5 | 11.0 | 12.5 | 15.0 | | | | | |
| | Cyan | 9.0 | 10.5 | 11.5 | 13.0 | 16.0 | | | | | |
| Comp. Ex. | Comp. Black No. | | | | | | | | | | |
| 8 | 1 | 3.5 | 4.0 | 5.0 | 5.5 | 6.5 | 165–220 | B | A | A | D |
| 9 | 2 | 3.0 | 3.5 | 4.0 | 4.5 | 5.5 | 145–220 | A | A | A | D |
| 10 | 3 | — | 3.0 | 4.0 | 4.5 | 5.5 | 175–220 | A | A | A | D |
| 11 | 4 | 15.0 | 22.0 | 30.0 | — | — | 150–170 | C | D | C | — |
| 12 | 5 | — | — | — | — | — | none | — | — | — | — |
| 13 | 6 | — | — | 10.5 | 12.0 | 15.0 | 170–220 | C | C | C | A |
| 14 | 7 | — | 12.0 | — | — | — | 160 | D | D | C | — |
| Ex. | Black No. | | | | | | | | | | |
| 12 | 2 | 6.5 | 7.5 | 11.0 | 14.5 | 19.0 | 140–210 | A | A | A | A |
| 13 | 3 | 4.0 | 6.5 | 9.5 | 12.0 | 16.0 | 155–220 | A | B | A | A |
| 14 | 4 | 4.0 | 6.0 | 9.0 | 11.0 | 14.0 | 165–220 | A | B | A | A |
| 15 | 5 | 6.0 | 8.0 | 11.5 | 14.5 | 19.0 | 140–210 | B | C | B | B |
| 16 | 6 | 5.5 | 7.5 | 10.0 | 13.0 | 18.0 | 145–220 | B | B | B | B |
| 17 | 7 | 5.5 | 7.0 | 9.0 | 12.0 | 16.0 | 145–200 | B | C | B | B |
| 18 | 8 | 7.0 | 8.5 | 11.0 | 14.0 | 19.0 | 140–210 | A | A | B | A |
| 19 | 9 | 5.3 | 7.2 | 10.5 | 13.5 | 18.0 | 145–220 | B | C | A | B |
| 20 | 10 | 5.3 | 7,2 | 10.5 | 13.5 | 18.0 | 145–220 | B | A | A | A |

The gloss of a fixed image was measured with respect to a solid image formed by a single color-mode by using a handy gloss meter ("PG-3D", available from Nippon Denshoku Kogyo K.K.) at a light incidence angle of 75 deg.

The results are shown in Table 6 appearing hereinafter together with those of Examples described below.

EXAMPLES 12–20 AND COMPARATIVE EXAMPLES 9–14

Image forming tests were performed in the same manner as in Example 11 except for using Magnetic black toners Nos. 2–10 and Comparative Magnetic black toners Nos. 1–7.

EXAMPLE 21

An image forming test was performed in the same manner as in Example 11 except for using Photosensitive member

What is claimed is:

1. A magnetic black toner for developing an electrostatic latent image, comprising: (a) magnetic black toner particles containing a binder resin, a magnetic material and a first solid wax, and (b) inorganic fine powder, wherein (i) the magnetic material is contained in 30–200 wt. parts per 100 wt. parts of the binder resin, (ii) the first solid wax provides a DSC heat-absorption main peak in a range of 60°–120° C., (iii) the first solid wax shows a ratio Mw/Mn between weight-average molecular weight (Mw) and number-average molecular weight (Mn) of 1.0–2.0, (iv) the binder resin has a THF (tetrahydrofuran)-insoluble content of at most 5 wt. %, (v) the binder resin contains a THF-soluble content providing a GPC chromatogram showing a molecular weight distribution including a content (M1) at 40–70% of components having molecular weights of below $5\times10^4$, a content (M2) at 20–45% of components having molecular weights of $5\times10^4$–$5\times10^4$, and a content (M3) at 2–25% of components having molecular weights exceeding $5\times10^5$, satisfying M1≧M2>M3, and (vi) the magnetic black toner exhibits viscoelasticity characteristics including a value C of tan δ at 100° C. and a value D of tan δ at 150° C. giving a ratio D/C of at least 1.0, and a minimum (Emin) and a maximum (Emax) of tan δ within a temperature range of 150°–190° C. both falling in a range of 0.5–3.0.

2. The toner according to claim 1, wherein the minimum and the maximum of tan δ of the magnetic black toner in the temperature range of 150°–190° C. are both in the range of 1.0 to 2.0.

3. The toner according to claim 1, wherein the magnetic black toner particles have a shape factor SF-1 of 110–180, and a shape factor SF-2 of 110–140 and provide A=SF-1-100 and B=SF-2-100 satisfying a ratio B/A of at most 1.0.

4. The toner according to claim 1, wherein the magnetic black toner particles have a shape factor SF-1 of 120–160, and a shape factor SF-2 of 115–140.

5. The toner according to claim 1, wherein the binder resin comprises a styrene copolymer.

6. The toner according to claim 1, wherein said first inorganic fine powder comprises at least one species of inorganic fine powder selected from the group consisting of titania fine powder, alumina fine powder, silica fine powder and fine powder of double oxides of these.

7. The toner according to claim 1, wherein said first inorganic fine powder is hydrophobic inorganic fine powder obtained through hydrophobization.

8. The toner according to claim 7, wherein said hydrophobic inorganic fine powder has been treated with silicone oil.

9. The toner according to claim 1, wherein said first inorganic fine powder has an average primary particle size of at most 30 nm.

10. The toner according to claims 1 or 9, wherein the magnetic black toner particles are further blended with second inorganic fine powder having an average primary particle size exceeding 30 nm.

11. The toner according to claim 10, wherein the second inorganic fine powder has a sphericity ψ of at least 0.90.

12. The toner according to claims 1 or 9, wherein the magnetic black toner particles are further blended with resin fine powder having an average primary particle size exceeding 30 nm.

13. The toner according to claim 12, wherein the resin fine powder has a sphericity ψ of at least 0.90.

14. The toner according to claim 1, wherein the magnetic black toner has a weight-average particle size of 4–8 μm.

15. The toner according to claim 1, wherein said first solid wax is low-molecular weight hydrocarbon wax.

16. The toner according to claim 1, wherein said first solid wax is low-molecular weight polyethylene wax.

17. The toner according to claim 1, wherein said first solid wax is long-chain alkyl alcohol wax.

18. The toner according to claim 1, wherein the magnetic material is contained in 30–200 wt. parts and the first solid wax is contained in 0.5–8 wt. parts, respectively per 100 wt. parts of the binder resin.

19. The toner according to claim 1, wherein the magnetic material is contained in 50–150 wt. parts and the first solid wax is contained in 1–8 wt. parts, respectively per 100 wt. parts of the binder resin.

20. The toner according to claim 1, wherein said first inorganic fine powder comprises silica fine powder surface-treated with dimethylsilicone oil.

21. The toner according to claim 20, wherein the silica-fine powder treated with dimethylsilicone oil is externally added in 0.5–5 wt. parts of 100 wt. parts of the magnetic black toner particles.

22. The toner according to claim 1, wherein the first solid wax has a number-average molecular weight (Mn) of 350–2000.

23. The toner according to claim 1, wherein the first solid wax has a number-average molecular weight (Mn) of 400–1000.

24. The toner according to claim 1, wherein the magnetic black toner has a gloss characteristic such that it provide a gloss value of solid image in the range of 10–30 when a solid image thereof on a plain paper is subjected to oil-less fixation by using a heat-pressure fixation device including a heating roller comprising an aluminum cylinder having an outer diameter of 40 mm coated successively with a 3 mm-thick silicone rubber layer and a 50 μm-thick outermost fluorine-containing resin (PFA) layer, and a pressure roller comprising an aluminum cylinder having an outer diameter of 40 mm and successively coated with a 2 mm-thick silicone rubber layer and a 50 μm-thick outermost fluorine-containing resin (PFA) layer under fixing conditions including a total pressure of 45 kg/30 cm, a fixing nip width of 6.5 mm, a fixing speed of 120 mm/sec and a heating roller surface temperature of 190° C. without applying release oil onto the heating roller.

25. The toner according to claim 1, wherein the magnetic black toner particles have been prepared by melt-kneading a blend comprising the binder resin, the magnetic material and the first solid wax, cooling the melt-kneaded product, and pulverizing the cooled melt-kneaded product.

26. A multi-color or full-color image forming method, comprising:

(1) developing an electrostatic latent image with a developer comprising a non-magnetic yellow toner to form a yellow toner image on an image bearing member, and then transferring the yellow toner image onto a transfer-receiving material via or without via an intermediate transfer member, (2) developing an electrostatic latent image with a developer comprising a non-magnetic magenta toner to form a magenta toner image on an image bearing member, and then transferring the magenta toner image onto a transfer-receiving material via or without via an intermediate transfer member, (3) developing an electrostatic latent image with a developer comprising a non-magnetic cyan toner to form a cyan toner image on an image bearing member, and then transferring the cyan toner image onto a transfer-receiving material via or without via an intermediate transfer member, (4) developing an electrostatic latent image with a magnetic black toner to form a magnetic black toner image on an image bearing member, and then transferring the magnetic black toner image onto a transfer-receiving material via or without via an intermediate transfer member, and (5) fixing under application of heat and pressure the yellow toner image, the magenta toner image, the cyan toner image and the magnetic black toner image on the transfer-receiving material by means of a heat-pressure fixation device not equipped with an oil applicator to form a multi-color or full-color image on the transfer-receiving material, wherein the magnetic black toner comprises (a) magnetic black toner particles containing a binder resin, a magnetic material and a first solid wax, and (b) first inorganic fine powder, wherein (i) the magnetic material is contained in 30–200 wt. parts per 100 wt. parts of the binder resin, (ii) the first solid wax provides a DSC heat-absorption main peak in a range of 60°–120° C., (iii) the first solid wax shows a ratio Mw/Mn between weight-average molecular weight (Mw) and number-average molecular weight (Mn) of 1.0–2.0, (iv) the binder resin has a THF (tetrahydrofuran)-insoluble content of at most 5 wt. %, (v) the binder resin contains a THF-soluble content providing a GPC chromatogram showing a molecular weight distribution including a content (M1) at 40–70% of components having molecular weights of below $5\times10^4$, a content (M2) at 20–45% of components having molecular weights of $5\times10^4$–$5\times10^4$, and a content (M3) at 2–25% of components having molecular weights exceeding $5\times10^5$, satisfying M1≧M2>M3, and (vi) the magnetic black toner exhibits viscoelasticity characteristics including a value C of tan δ at 100° C. and a value D of tan δ at 150° C. giving a ratio D/C of at least 1.0, and a minimum (Emin) and a maximum (Emax) of tan δ within a temperature range of 150°–190° C. both falling in a range of 0.5–3.0.

27. The image forming method according to claim 26, wherein the non-magnetic yellow toner comprises non-magnetic yellow toner particles containing 100 wt. parts of a binder resin, 1–20 wt. parts of a yellow colorant, and 5–40 wt. parts of a second solid wax having a DSC heat-absorption main peak in a range of 60°–120° C., the non-magnetic magenta toner comprises non-magnetic magenta toner particles containing 100 wt. parts of a binder resin, 1–20 wt. parts of a magenta colorant, and 5–40 wt. parts of a third solid wax having a DSC heat-absorption main peak in a range of 60°–120° C., and the non-magnetic cyan toner comprises non-magnetic cyan toner particles containing 100 wt. parts of a binder resin, 1–20 wt. parts of a cyan colorant, and 5–40 wt. parts of a fourth solid wax having a DSC heat-absorption main peak in a range of 60°–120° C.

28. The image forming method according to claim 27, wherein the second to fourth solid waxes are respectively a solid ester wax.

29. The image forming method according to claim 27, wherein the non-magnetic yellow, magenta and cyan toner particles respectively have a shape factor SF-1 of 100–160.

30. The image forming method according to claim 27, wherein the non-magnetic yellow, magenta and cyan toner particles respectively have a shape factor SF-1 of 100–150.

31. The image forming method according to claim 27, wherein the non-magnetic yellow, magenta and cyan toner particles respectively have a shape factor SF-1 of 100–125.

32. The image forming method according to claim 27, wherein the non-magnetic yellow, magenta and cyan toner particles, respectively, have been obtained through a process including steps of forming into particles of a polymerizable monomer mixture comprising a polymerizable vinyl monomer, a colorant, a solid wax and a polar polymer in an aqueous medium, and subjecting the particles to polymerization in the aqueous medium.

33. The image forming method according to claim 26, wherein the heat-pressure fixation device includes a heating roller having an outermost layer comprising a fluorine-containing resin, and a pressure roller having an outermost layer comprising a fluorine-containing resin.

34. The image forming method according to claim 26, wherein the non-magnetic yellow, magenta and cyan toner are respectively applied as a layer on a developing sleeve and transferred under application of a developing bias voltage to develop the electrostatic latent image on the image bearing member.

35. The image forming method according to claim 26, wherein each of the non-magnetic yellow, magenta and cyan toners has a magnetic black toner has a gloss characteristic such that it provide a gloss value of solid image in the range of 10–30 when a solid image thereof on a plain paper is subjected to oil-less fixation by using a heat-pressure fixation device including a heating roller comprising an aluminum cylinder having an outer diameter of 40 mm coated successively with a 3 mm-thick silicone rubber layer and a 50 μm-thick outermost fluorine-containing resin (PFA) layer, and a pressure roller comprising an aluminum cylinder having an outer diameter of 40 mm and successively coated with a 2 mm-thick silicone rubber layer and a 50 μm-thick outermost fluorine-containing resin (PFA) layer under fixing conditions including a total pressure of 45 kg/30 cm, a fixing nip width of 6.5 mm, a fixing speed of 120 mm/sec and a heating roller surface temperature of 190° C. without applying release oil onto the heating roller.

36. The image forming method according to claim 26, wherein the minimum and the maximum of tan δ of the magnetic black toner in the temperature range of 150°–190° C. are both in the range of 1.0 to 2.0.

37. The image forming method according to claim 26, wherein the magnetic black toner particles have a shape factor SF-1 of 110–180, and a shape factor SF-2 of 110–140 and provide A=SF-1-100 and B=SF-2-100 satisfying a ratio B/A of at most 1.0.

38. The image forming method according to claim 26, wherein the magnetic black toner particles have a shape factor SF-1 of 120–160, and a shape factor SF-2 of 115–140.

39. The image forming method according to claim 26, wherein the binder resin comprises a styrene copolymer.

40. The image forming method according to claim 26, wherein said first inorganic fine powder comprises at least one species of inorganic fine powder selected from the group consisting of titania fine powder, alumina fine powder, silica fine powder and fine powder of double oxides of these.

41. The image forming method according to claim 26, wherein said first inorganic fine powder is hydrophobic inorganic fine powder obtained through hydrophobization.

42. The image forming method according to claim 41, wherein said hydrophobic inorganic fine powder has been treated with silicone oil.

43. The image forming method according to claim 26, wherein said first inorganic fine powder has an average primary particle size of at most 30 nm.

44. The image forming method according to claims 26 or 43, wherein the magnetic black toner particles are further blended with second inorganic fine powder having an average primary particle size exceeding 30 nm.

45. The image forming method according to claim 44, wherein the second inorganic fine powder has a sphericity ψ of at least 0.90.

46. The image forming method according to claims 26 or 43, wherein the magnetic black toner particles are further blended with resin fine powder having an average primary particle size exceeding 30 nm.

47. The image forming method according to claim 46, wherein the resin fine powder has a sphericity ψ of at least 0.90.

48. The image forming method according to claim 26, wherein the magnetic black toner has a weight-average particle size of 4–8 μm.

49. The image forming method according to claim 26, wherein said first solid wax is low-molecular weight hydrocarbon wax.

50. The image forming method according to claim 26, wherein said first solid wax is low-molecular weight polyethylene wax.

51. The image forming method according to claim 26, wherein said first solid wax is long-chain alkyl alcohol wax.

52. The image forming method according to claim 26, wherein the magnetic material is contained in 30–200 wt. parts and the first solid wax is contained in 0.5–8 wt. parts, respectively per 100 wt. parts of the binder resin.

53. The image forming method according to claim 26, wherein the magnetic material is contained in 50–150 wt. parts and the first solid wax is contained in 1–8 wt. parts, respectively per 100 wt. parts of the binder resin.

54. The image forming method according to claim 26, wherein said first inorganic fine powder comprises silica fine powder surface-treated with dimethylsilicone oil.

55. The image forming method according to claim 54, wherein the silica-fine powder treated with dimethylsilicone oil is externally added in 0.5–5 wt. parts of 100 wt. parts of the magnetic black toner particles.

56. The image forming method according to claim 26, wherein the first solid wax has a number-average molecular weight (Mn) of 350–2000.

57. The image forming method according to claim 26, wherein the first solid wax has a number-average molecular weight (Mn) of 400–1000.

58. The image forming method according to claim 26, wherein the magnetic black toner has a gloss characteristic such that it provide a gloss value of solid image in the range of 10–30 when a solid image thereof on a plain paper is subjected to oil-less fixation by using a heat-pressure fixation device including a heating roller comprising an aluminum cylinder having an outer diameter of 40 mm coated successively with a 3 mm-thick silicone rubber layer and a 50 μm-thick outermost fluorine-containing resin (PFA) layer, and a pressure roller comprising an aluminum cylinder having an outer diameter of 40 mm and successively coated with a 2 mm-thick silicone rubber layer and a 50 μm-thick outermost fluorine-containing resin (PFA) layer under fixing conditions including a total pressure of 45 kg/30 cm, a fixing nip width of 6.5 mm, a fixing speed of 120 mm/sec and a heating roller surface temperature of 190° C. without applying release oil onto the heating roller.

59. The image forming method according to claim 26, wherein the magnetic black toner particles have been prepared by melt-kneading a blend comprising the binder resin, the magnetic material and the first solid wax, cooling the melt-kneaded product, and pulverizing the cooled melt-kneaded product.

* * * * *

UNITED STATES PATENT AND TRADEMARK OFFICE

CERTIFICATE OF CORRECTION

PATENT NO. : 5,840,457

DATED : November 24, 1998

INVENTOR(S) : MOTOO URAWA ET AL.

It is certified that error appears in the above-identified patent and that said Letters Patent is hereby corrected as shown below:

COLUMN 2

Line 19, "42 an" should read --42 and an--.
Line 25, "solid" should read --soiled--.
Line 35, "having solved" should read --that solves--.

COLUMN 4

Line 58, "$5x10^4$-$5x10^4$" should read --$5x10^4$-$5x10^5$--.

COLUMN 6

Line 41, "obtained once" should read --first obtained--.
Line 65, "e" should read --be--.

COLUMN 8

Line 58, "patash-ethanol" should read --potash-ethanol--.

COLUMN 9

Line 4, "theses" should read --these--.
Line 53, "x100,]" should read --x100],--.

COLUMN 11

Line 10, "be" should read --be a--.

UNITED STATES PATENT AND TRADEMARK OFFICE

CERTIFICATE OF CORRECTION

PATENT NO. : 5,840,457

DATED : November 24, 1998

INVENTOR(S) : MOTOO URAWA ET AL.

It is certified that error appears in the above-identified patent and that said Letters Patent is hereby corrected as shown below:

COLUMN 13

Line 2, "on-magnetic" should read --non-magnetic--.
Line 61, "small" should read --smaller--.

COLUMN 14

Line 42, "methacrylate" should read --methacrylate,--.
Line 48, "vinyl" should be deleted.
Line 49, "benzoate" should be deleted.

COLUMN 17

Line 58, "used for constitutes a" should read --used in the--.
Line 67, "main" should read --main peak--.

COLUMN 18

Line 58, "kvpp," should read --kVpp--.
Line 63, "omitting" should read --preventing--.

COLUMN 19

Line 67, "wining" should read --winding--.

UNITED STATES PATENT AND TRADEMARK OFFICE

CERTIFICATE OF CORRECTION

PATENT NO. : 5,840,457

DATED : November 24, 1998

INVENTOR(S) : MOTOO URAWA ET AL.

It is certified that error appears in the above-identified patent and that said Letters Patent is hereby corrected as shown below:

COLUMN 20

Line 38, "an" should read --and--.
Line 42, "development" should read --development of--.

COLUMN 22

Line 28, "Example" should read --Examples--.

COLUMN 23

Line 53, "use "should read --case--.
Line 59, "lipophillicity" should read --lipophilicity--.

COLUMN 25

Line 6, "then" should read --their--.

COLUMN 30

Line 44, "an" should read --and--.
Line 67, "34 " should read --34 10--.

UNITED STATES PATENT AND TRADEMARK OFFICE

CERTIFICATE OF CORRECTION

PATENT NO. : 5,840,457

DATED : November 24, 1998

INVENTOR(S) : MOTOO URAWA ET AL.

It is certified that error appears in the above-identified patent and that said Letters Patent is hereby corrected as shown below:

COLUMN 33

Line 16, "wag" should read --was--.
Line 18, "plate" should read --place--.
Line 28, "$G'_{50}G'_{80}$" should read --$G'_{50}/G'_{80}$--.
Line 51, "roller" should read --roller with--.
Line 53, "Photosensitive" should read --photosensitive--.
Line 54, "member Production" should read --member of Production--.

COLUMN 34

Line 8, "silicon" should read --silicone--.

COLUMN 35

Line 2 "silicon" should read --silicone--.
Line 53, "handy" should read --hand--.

UNITED STATES PATENT AND TRADEMARK OFFICE

CERTIFICATE OF CORRECTION

PATENT NO. : 5,840,457

DATED : November 24, 1998

INVENTOR(S) : MOTOO URAWA ET AL.

It is certified that error appears in the above-identified patent and that said Letters Patent is hereby corrected as shown below:

COLUMN 36

Insert after Table 6:

--Notes to Table 6

1. In Comparative Example 11, high-temperature offset occurred at a temperature of 180°C or higher.

In Comparative Example 12, plain paper (transfer-receiving material) was wound about the heating roller at 150°C or higher.

In Comparative Example 13, low-temperature offset occurred at 160°C or below.

In Comparative Example 14, low-temperature offset occurred at 150°C or below, and high-temperature offset occurred at 170°C or higher.

In Comparative Example 11, 12 and 14, full-color image fixation could not be effected at 185°C, so that the full-color image quality evaluation would not be performed.

2. Evaluation method and standards are as follows.

(1) Black toner fixable temperature range

Fixed toner images at various fixing temperatures are each rubbed three times with soft tissue paper, and a range of fixing temperatures giving an image density lowering of below 10% while not causing the low- or high-temperature offset is indicated in Table 6.

(2) Image quality of black toner fixed images

A (excellent): No toner scattering around

UNITED STATES PATENT AND TRADEMARK OFFICE

CERTIFICATE OF CORRECTION

PATENT NO. : 5,840,457

DATED : November 24, 1998

INVENTOR(S) : MOTOO URAWA ET AL.

It is certified that error appears in the above-identified patent and that said Letters Patent is hereby corrected as shown below:

COLUMN 36 CONTINUED images and good reproducibility of dot latent images.

B (good): Little toner scattering around images, and excellent reproducibility of dot latent images.

C (fair): Toner scattering is observed around images, and some defect is observed with respect to reproduced dot images.

D (poor): Conspicuous toner scattering is observed around images, and many of reproduced dot images are accompanied with defects.

(3) Continuous image performance of black toner

A (excellent): Even after 5000 sheets of continuous image formation, image densities are stable and almost no fog is found in the non-image portion.

B (good): Even after 5000 sheets of continuous image formation, image densities are stable but slight fog is found in the non-image portion.

C (fair): After 5000 sheets of continuous image formation, a slight image density lowering is observed, and some non-image portion is accompanied with fog.

D (poor): After 5000 sheets of continuous image formation, a clear image density lowering is observed, and conspicuous fog is observed in the non-image portion.

(4) Winding of plain paper carrying a black toner image about a heating roller at the time of fixation was evaluated at 200°C and a fixing speed of 50 mm/sec.

UNITED STATES PATENT AND TRADEMARK OFFICE

CERTIFICATE OF CORRECTION

PATENT NO. : 5,840,457

DATED : November 24, 1998

INVENTOR(S) : MOTOO URAWA ET AL.

It is certified that error appears in the above-identified patent and that said Letters Patent is hereby corrected as shown below:

COLUMN 36 CONTINUED

A (excellent): No winding about the heating occurs.

B (fair): Plain paper are discharged while showing tendency of winding about the heating roller.

C (poor): Plain paper is sometimes wound about the heating roller.

(5) Full-color image quality

Full-color images formed by four-color toners including a Magnetic black toner and a fixing temperature of 185°C were observed with eyes while comparing them with standard full-color image samples.

A (excellent): High image quality. A gloss difference in a full-color image is at most 3.0.

B (good): Somewhat inferior image quality compared with A. A gloss difference in a full-color image is 3.1 - 5.0.

C (fair): Somewhat inferior image quality compared with B. A gloss difference in a full-color image is 5.1 - 7.0.

D (poor): Somewhat inferior image quality compared with C. A gloss difference in a full-color image is 7.1 or larger.

COLUMN 37

Line 3, "$5 \times 10^4 - 5 \times 10^4$," should read --$5 \times 10^4 - 5 \times 10^5$,--.

UNITED STATES PATENT AND TRADEMARK OFFICE

CERTIFICATE OF CORRECTION

PATENT NO. : 5,840,457

DATED : November 24, 1998

INVENTOR(S) : MOTOO URAWA ET AL.

It is certified that error appears in the above-identified patent and that said Letters Patent is hereby corrected as shown below:

COLUMN 38

Line 11, "provide" should read --provides--.

COLUMN 40

Line 10, "has" should read --having--.
Line 11, "provide" should read --provides--.

COLUMN 42

Line 6, "provide" should read --provides--.

Signed and Sealed this

Fourteenth Day of September, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,840,457

DATED : November 24, 1998

INVENTOR(S) : MOTOO URAWA ET AL.

It is certified that error appears in the above-identified patent and that said Letters Patent is hereby corrected as shown below:

COLUMN 39

Line 17, "$5x10^4$-$5x10^4$," should read --$5x10^4$-$5x10^5$,--.

Signed and Sealed this

Eleventh Day of April, 2000

*Attest:*

*Attesting Officer*

Q. TODD DICKINSON

*Director of Patents and Trademarks*